US010558155B1

(12) United States Patent
Sugai

(10) Patent No.: US 10,558,155 B1
(45) Date of Patent: Feb. 11, 2020

(54) IMAGE FORMING APPARATUS

(71) Applicant: KONICA MINOLTA, INC., Chiyoda-ku, Tokyo (JP)

(72) Inventor: Shun Sugai, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/508,488

(22) Filed: Jul. 11, 2019

(30) Foreign Application Priority Data

Jul. 25, 2018 (JP) ..... 2018-139397

(51) Int. Cl.
*G03G 15/043* (2006.01)
*G03G 15/00* (2006.01)

(52) U.S. Cl.
CPC ..... *G03G 15/5029* (2013.01); *G03G 15/043* (2013.01); *G03G 15/6529* (2013.01)

(58) Field of Classification Search
CPC ..... G03G 15/5029; G03G 15/6529; G03G 15/043; G03G 15/0415
See application file for complete search history.

(56) References Cited

U.S. PATENT DOCUMENTS 7,277,113 B2 * 10/2007 Sobue ..... G02B 26/127 347/235
9,158,224 B2 * 10/2015 Jung ..... G03G 15/043

FOREIGN PATENT DOCUMENTS

JP 2016099599 A 5/2016

* cited by examiner

*Primary Examiner* — Hoang X Ngo
(74) *Attorney, Agent, or Firm* — Buchanan Ingersoll & Rooney PC

(57) ABSTRACT

An image forming apparatus that conveys a sheet and prints an image on the sheet, includes: a sheet feed tray on which the sheet is placed; a motor that drivingly rotates a polygon mirror with which a latent image corresponding to the image is formed; a hardware processor that identifies a type of the sheet based on an output from a sensor provided between the sheet feed tray and a position at which the printing takes place, on a conveyance path for the sheet; and a motor controller that changes a rotation speed of the motor to a first speed, starting from a startup timing synchronized with starting of conveyance of the sheet, wherein the startup timing is set in such a manner that an identification timing at which the type of the sheet is identified arrives while the changing to the first speed is still in progress.

11 Claims, 17 Drawing Sheets

FIG. 6A

81

D25

| TRAY (SHEET TRAY) | SIZE SS | ORIENTATION SD | TYPE SK | TYPE IDENTIFICATION MODE SKM |
|---|---|---|---|---|
| SHEET FEED TRAY 25a | A4 | LANDSCAPE (H) | (null) | AUTO |
| SHEET FEED TRAY 25b | A4 | PORTRAIT (V) | PLAIN PAPER | AUTO |
| SHEET FEED TRAY 25c | A4 | LANDSCAPE (H) | (null) | AUTO |
| MANUAL FEED TRAY 25d | A3 | PORTRAIT (V) | THICK PAPER 1 | MANUAL |

FIG. 6B

82

| TYPE NAME | BASIS WEIGHT [g/m$^2$] (DETECTION SIGNAL VALUE) |
|---|---|
| PLAIN PAPER | 60 TO 90 |
| THICK PAPER 1 | 91 TO 120 |
| THICK PAPER 2 | 121 TO 157 |
| THICK PAPER 3 | 158 TO 256 |
| THICK PAPER 4 | 257 TO 300 |

FIG. 6C

83

| TYPE SK | PLAIN PAPER | THICK PAPER 1 | THICK PAPER 2 | THICK PAPER 3 | THICK PAPER 4 |
|---|---|---|---|---|---|
| TOTAL NUMBER OF PRINTED SHEETS PN | 12064 | 146 | 24 | 0 | 305 |

FIG. 7A

84

| ITEM \ TYPE GROUP SKG / TYPE SK | SKG1 | | SKG2 | SKG3 | ALL TYPES |
|---|---|---|---|---|---|
| | PLAIN PAPER (MONOCHROME) | PLAIN PAPER (COLOR) | THICK PAPER 1 THICK PAPER 2 | THICK PAPER 3 THICK PAPER 4 | |
| NUMBER OF PRINTED SHEETS [/min] | 75 | 65 | — — | — — | — — |
| SYSTEM SPEED [mm/s] | 325 | 290 | 162.5 | 108.3 | 108.3 |
| RESOLUTION (SUB-SCANNING) [dpi] | 600 (NORMAL RESOLUTION) | | | | 1200 HIGH (RESOLUTION) |
| NUMBER OF MIRROR SURFACES | 7 | | | | 7 |
| NUMBER OF BEAMS (COLORS) | 2 | | | | 1 |
| TARGET ROTATION SPEED N [rpm] | 32902 (N4) | 29359 (N3) | 16451 (N2) | 10964 (N1) | 43856 (N5) |

FIG. 7B

85

| No. | RELATIONSHIP BETWEEN Na AND Nb | PROVISIONAL TARGET ROTATION SPEED Na | DETERMINED TARGET ROTATION SPEED Nb | STARTUP SHIFT TIME dT | | | |
|---|---|---|---|---|---|---|---|
| | | | | TRAY 25a | TRAY 25b | TRAY 25c | TRAY 25d |
| 1 | Na<Nb | N1 | N2 | dT(a1) | dT(b1) | dT(c1) | dT(d1) |
| 2 | | | N3 | | | | |
| 3 | | | N4 | | | | |
| 4 | | N2 | N3 | dT(a2) | dT(b2) | dT(c2) | dT(d2) |
| 5 | | | N4 | | | | |
| 6 | Na>Nb | N4 | N2 | dT(a3) | dT(b3) | dT(c3) | dT(d3) |
| 7 | | | N1 | | | | |
| 8 | | N3 | N2 | dT(a4) | dT(b4) | dT(c4) | dT(d4) |
| 9 | | | N1 | | | | |
| 10 | | N2 | N1 | dT(a5) | dT(b5) | dT(c5) | dT(d5) |

IMAGE FORMING APPARATUS

The entire disclosure of Japanese patent Application No. 2018-139397, filed on Jul. 25, 2018, is incorporated herein by reference in its entirety.

BACKGROUND

Technological Field

The present invention relates to an image forming apparatus.

Description of the Related Art

Image forming apparatuses, such as a printer, a copier, or a multi-functional peripheral (MFP), include a sheet feed tray (a tray for sheets to be fed) in which a plurality of sheets, each used as an image recording medium, are set. Printing is performed with the sheet conveyed from the sheet feed tray to a print position inside the apparatus.

A known function of this type of image forming apparatus includes a function of setting an operation condition so that an appropriate image can be obtained based on the type of the sheet. For example, in an electrophotographic image forming apparatus, it is a common practice that sheets are classified according to their basis weight, and conveyance speed, developing bias, transfer bias, fixing temperature, and the like are set according to the basis weight. This configuration can prevent paper jam, development failure, transfer failure, fixing failure, and the like.

A method for the image forming apparatus to acquire the type of sheets includes a method in which the user selects and designates the type of the sheet from several options (plain paper, thin paper, thick paper, etc.). The image forming apparatus sets an operation condition according to the type designated by the user.

However, in recent years, a wide variety of types of sheets can be used in image forming apparatuses, making it difficult for the user to correctly designate the type of sheets. In view of this, a method in which an image forming apparatus automatically identifies the type of sheets based on an output from a predetermined sensor has been attracting attention.

Generally, a sensor for identifying the type is provided between a sheet feed tray and a print position on a conveyance path, and detects an attribute of a sheet picked up from the sheet feed tray to be in a single piece state. The sensor thus provided on the conveyance path can detect an attribute (for example, light transparency) that is difficult to detect while the sheets are in a state of being stacked on the sheet feed tray. Furthermore, with such a configuration, a plurality of sheet feed trays can be provided, without the need for the sensor to be provided for each of the sheet feed trays. However, the type cannot be identify before the start of the conveyance of the sheet.

Meanwhile, in electrophotographic image forming apparatuses, a circumference surface of a cylindrical photoreceptor is irradiated with light (pattern exposure) corresponding to image data while being charged with the photoreceptor rotated. Thus, charges on the circumference surface are partially removed, so that a latent image (electrostatic latent image) is formed.

In one widely employed scheme for the pattern exposure, main scanning is performed line by line with a polygon mirror deflecting a laser beam to be in a direction toward a rotation axis of the photoreceptor. This scheme requires the polygon mirror to be accurately rotated at a constant speed.

Thus, the polygon mirror is designed to feature a large moment of inertia. Such a large moment of inertia contributes to stable rotation but results in a considerable amount of time required for starting up the polygon mirror in a stopped state to be in a stable rotation state, in which image forming can be performed.

JP 2016-99599 A discloses one related art technique for preventing first print output time (FPOT) from being long due to the need to wait for the polygon mirror to start up. The FPOT is a time between issuing of a print instruction from a user and discharging of the first sheet on which an image is printed.

JP 2016-99599 A discloses motor control including: rotating the polygon motor in advance at a speed lower than that at the time of image forming before the user performs an operation of instructing copy start, and starting up the polygon motor in the low speed rotation state to be in a high speed rotation state suitable for the image forming, when the operation is performed. The motor control disclosed further includes immediately changing a setting value of speed control from a low speed to a high speed to start up the polygon motor to be in the high speed rotation state, when image data to be printed is received from an external device while the acceleration from the low speed to the high speed is in progress.

A target speed, which is the rotation speed of the polygon mirror at the time of image forming, may vary depending on the type of sheets. In such a case, the target speed is not determined until the type is identified.

A sequence of determining the type and then setting the target speed to start up the polygon mirror leads to a delay in the start of the pattern exposure, resulting in a longer FPOT, in the image forming apparatus having the sensor for identifying the type provided on the conveyance path as described above.

In view of this, one of a plurality of anticipated types may be selected as a provisional type, and the polygon mirror may be started up in advance with a target speed for the provisional type set as a provisional target speed, before the type is identified. This configuration enables the pattern exposure to be immediately started, so that the shortest possible FPOT can be achieved, if the type identified matches the provisional type.

However, if the type identified does not match the provisional type, the rotation speed of the polygon mirror needs to be changed from the provisional target speed to the target speed corresponding to the type identified. In such a case, this change in the rotation speed requires a considerable amount of time due to the inertia acting to maintain the stable rotation state with the provisional target speed.

As described above, the technique disclosed in JP 2016-99599 A includes switching the target speed of rotation control when image data while the acceleration is in progress. The reception of the image data is equivalent to the input of the print start instruction. Thus, the target speed of the polygon mirror is determined when the image data is received. In other words, the timing at which the print start is instructed and the timing at which the target speed is determined are the same.

On the other hand, when the identification of the type is involved, a sheet starts to be conveyed in response to an instruction to start printing, and the target speed of the polygon mirror at the time of the image forming is determined when the type of the sheet is identified thereafter. Thus, the timing at which the print start is instructed and the timing at which the target speed is determined are different from each other.

All things considered, the technique disclosed in JP 2016-99599 A cannot be applied to the image forming apparatuses involving the identification of the type, and thus cannot solve the problem described above.

SUMMARY

The present invention is made in view of the above-described problems, and an object of the present invention is to enable startup to be swiftly performed, with a type of a sheet identified, for making a polygon mirror transition to a rotation state with a speed corresponding to the type.

To achieve the abovementioned object, according to an aspect of the present invention, an image forming apparatus that conveys a sheet and prints an image on the sheet reflecting one aspect of the present invention comprises: a sheet feed tray on which the sheet is placed; a motor that drivingly rotates a polygon mirror with which a latent image corresponding to the image is formed; a hardware processor that identifies a type of the sheet based on an output from a sensor provided between the sheet feed tray and a position at which the printing takes place, on a conveyance path for the sheet; and a motor controller that changes a rotation speed of the motor to a first speed, starting from a startup timing synchronized with starting of conveyance of the sheet, wherein the startup timing is set in such a manner that an identification timing at which the type of the sheet is identified arrives while the changing to the first speed is still in progress, and when a second speed corresponding to the type identified is different from the first speed, the motor controller controls the motor to rotate at the second speed.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 6A to 6C are diagrams respectively illustrating examples of tray information used type information, and a sheet determination table;

FIGS. 7A and 7B respectively illustrate examples of a polygon speed table and a startup setting table;

DETAILED DESCRIPTION OF EMBODIMENTS

Hereinafter, one or more embodiments of the present invention will be described with reference to the drawings. However, the scope of the invention is not limited to the disclosed embodiments.

Figure 1A:
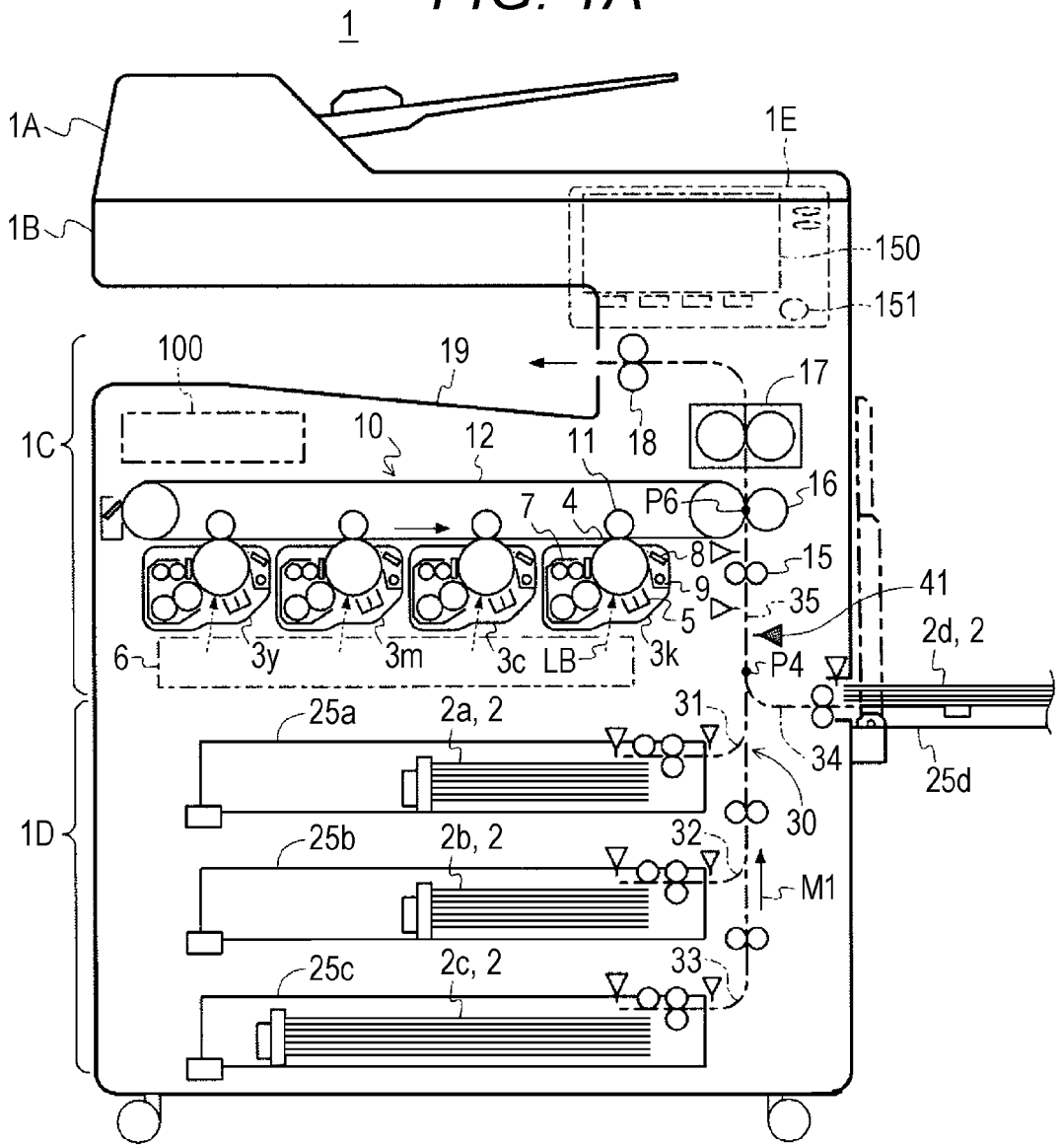
FIGS. 1A and 1B are diagrams illustrating an overview of a configuration of an image forming apparatus according to an embodiment of the present invention.
Figure 1B:
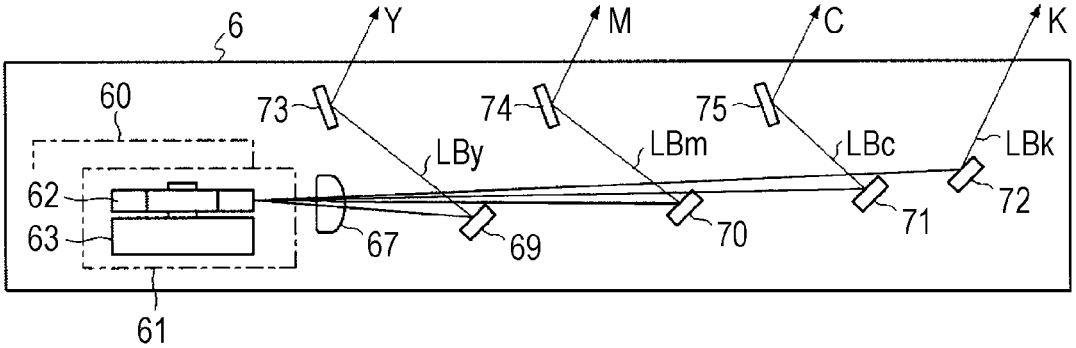
Figure 2:
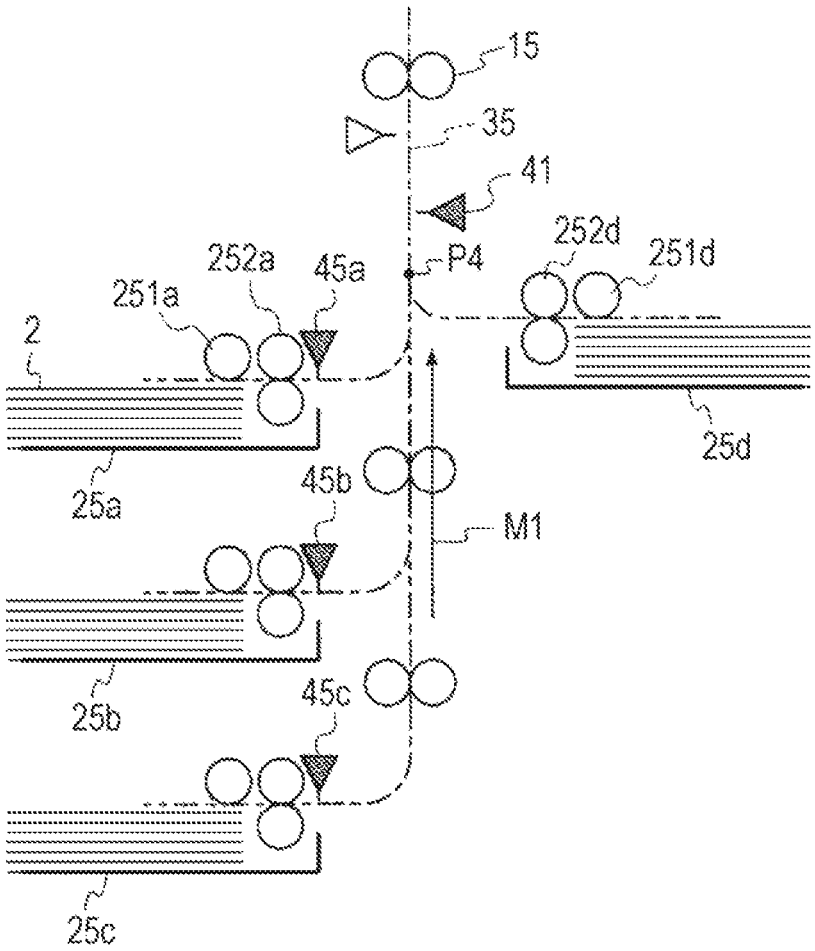
FIG. 2 is a diagram illustrating an example of an arrangement of sheet feed sensors.
Figure 3A:
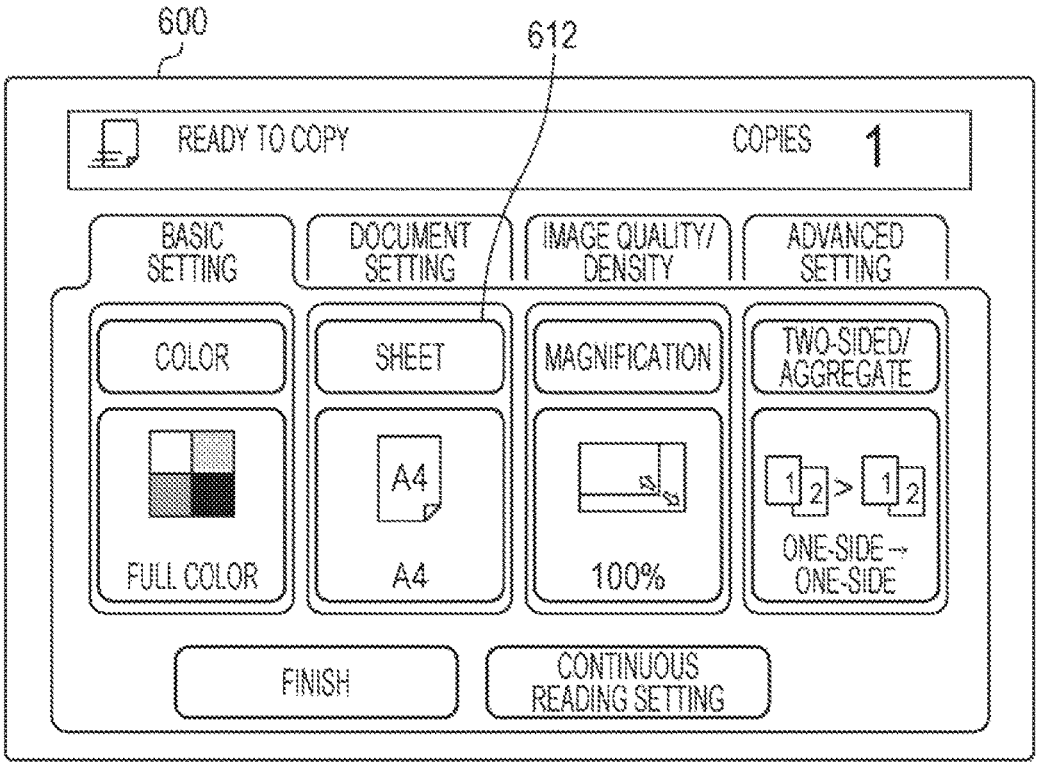
FIGS. 3A and 3B are diagrams each illustrating an example of an operation screen related to identification of a type of a sheet.
Figure 3B:
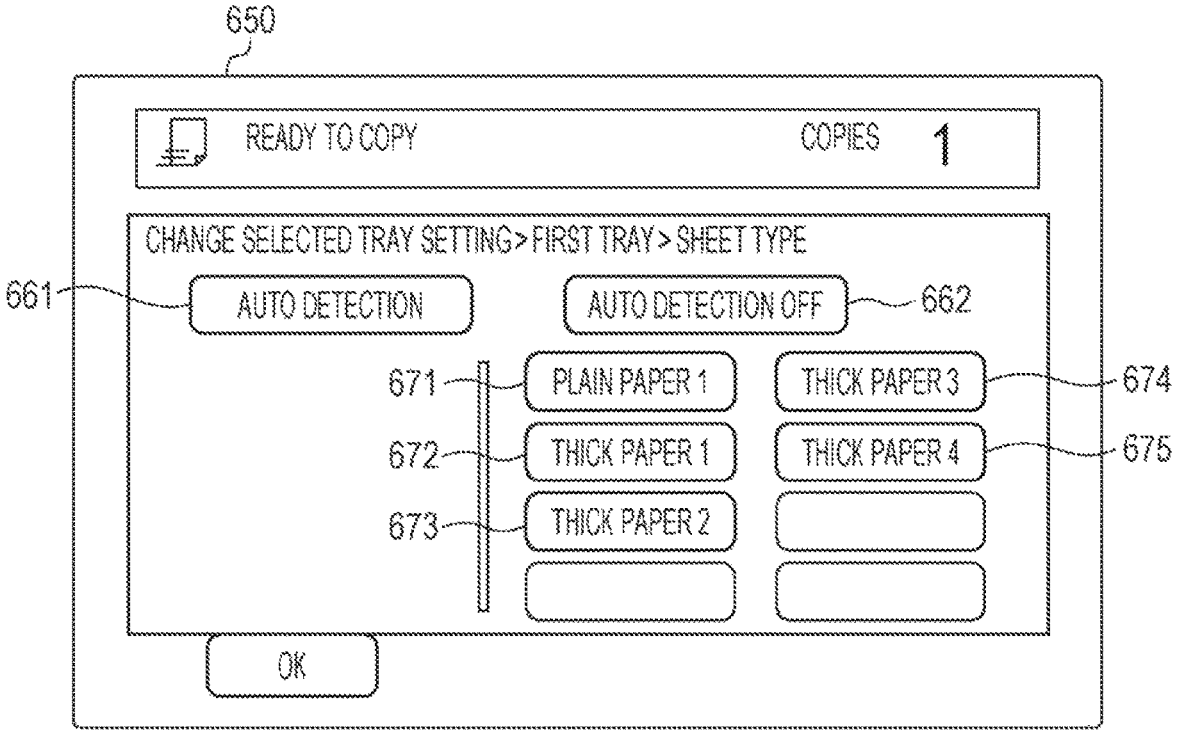

FIGS. 1A and 1B illustrate an overview of a configuration of an image forming apparatus 1 according to an embodiment of the present invention. FIG. 2 illustrates an example of an arrangement of sheet feed sensors 45. FIGS. 3A and 3B illustrate examples of respective operation screens 600 and 650 related to identification of a type SK of a sheet 2.

The image forming apparatus 1 in FIG. 1A is a multi-functional peripheral (MFP) integrally having functions of a copier, a printer, a facsimile machine, an image reader, and the like.

The image forming apparatus 1 includes an auto document feeder (ADF) 1A, a flatbed scanner 1B, an electrophotographic color printer 1C, a sheet cabinet 1D, an operation panel 1E, and the like.

The sheet cabinet 1D is of a three-stage draw out type including sheet feed trays 25*a*, 25*b*, and 25*c*. The image forming apparatus 1 has a right side surface provided with a manual feed tray 25*d*. The operation panel 1E has a touch panel display 150 for displaying a screen for a user to perform an operation thereon, a start key 151 for instructing start of execution of a job, and the like, and outputs a signal corresponding to an input operation. In response to this signal, a control circuit 100 controls operations performed by the image forming apparatus 1.

The auto document feeder 1A conveys a document (sheet) set in a document tray to a reading position of the scanner 1B. The scanner 1B reads an image from a sheet-like document conveyed from the auto document feeder 1A or various documents set on a platen glass to generate image data.

The color printer 1C forms a color or monochrome image on the sheet (recording medium) 2 in a print job such as copying, network printing (PC printing), facsimile reception, and box printing. The color printer 1C includes a tandem type printer engine 10. The printer engine 10 includes four imaging units 3*y*, 3*m*, 3*c*, and 3*k*, a print head 6, and an intermediate transfer belt 12.

Each of the imaging units 3*y* to 3*k* has a cylindrical photoreceptor 4, a charger 5, a developer 7, an eraser 8, a cleaner 9, and the like. The eraser 8 electrically discharges the photoreceptor 4 by light irradiation. The cleaner 9 removes adhering substances such as residual toner from the photoreceptor 4, with a blade brought into contact with the photoreceptor 4, for example. The imaging units 3*y* to 3*k* have similar basic configurations.

The print head 6 emits a laser beam LB for performing pattern exposure, to each of the imaging units 3*y* to 3*k*. As illustrated in FIG. 1B, the print head 6 includes a light source unit 61, a polygon mirror 62, a polygon motor 63, an fθ lens 67, reflection mirrors 69 to 75, and the like. Main scanning is performed with the polygon mirror 62 driven by the polygon motor 63 to rotate at a high speed in the print head 6, so that laser beams LBy, LBm, LBc, and LBk, respectively corresponding to the imaging units 3*y* to 3*k*, are deflected to be in directions toward the rotation axes of the photoreceptors 4. In parallel with this main scanning, sub-scanning is performed with the photoreceptor 4 rotating at a constant speed.

The intermediate transfer belt 12, serving as a transfer target object in a primary transfer of a toner image, rotates while being wound around a pair of rollers. On the inner side of the intermediate transfer belt 12, primary transfer rollers 11 are arranged for the respective imaging units 3*y*, 3*m*, 3*c*, and 3*k*.

In a color printing mode, the imaging units 3*y* to 3*k* concurrently form toner images of four colors of yellow (Y), magenta (M), cyan (C), and black (K). The toner images of the four colors are primary transferred one by one onto the rotating intermediate transfer belt 12. The Y toner image of is first transferred, and then the M toner image, the C toner image, and the K toner image are transferred in this order in an overlapping manner.

The toner image as a result of the primary transfer is secondary transferred onto a sheet 2 positioned at a print position P6 to face a secondary transfer roller 16, after being picked up from any one of the sheet feed trays 25*a* to 25*c* or the manual feed tray 25*d* and then conveyed through timing rollers 15. After the secondary transfer, the sheet 2 passes through the inside of a fixing device 17 and is delivered to a discharge tray 19 by discharge rollers 18. The sheet 2 is heated and pressed while passing through the fixing device 17, so that the toner image is fixed on the sheet 2.

The upper sheet feed tray 25*a*, the middle sheet feed tray 25*b*, and the lower sheet feed tray 25*c* in the sheet cabinet 1D have the same basic configuration, and may each have a large number of sheets 2 (2*a*. 2*b*, 2*c*) set therein. The term setting means overlapping placement on the sheet feed tray. The sheets 2*a* to 2*c* respectively set in the sheet feed trays 25*a* to 25*c* may be the same or different from each other in the size and type.

The sheet feed trays 25*a* to 25*c* are provided with size sensors for detecting the sizes and orientations of the respective sheets 2*a* to 2*c* set therein. These size sensors can detect the size and the orientation at a timing before the sheets 2*a* to 2*c* start to be conveyed.

As illustrated in FIG. 2, the upper sheet feed tray 25*a* includes a pickup roller 251*a*, sheet feed rollers 252*a*, and a sheet feed sensor 45*a*. The uppermost sheet 2, in the stack of sheets set in the sheet feed tray 25*a*, is picked up by the pickup roller 251*a* and is fed toward the downstream side by the sheet feed rollers 252*a*.

The sheet feed sensor 45*a* is disposed close to and on the downstream side of the sheet feed rollers 252*a*, and detects the presence of the sheet 2 at this disposed position of the sheet feed sensor 45*a*. When the sheet 2 is fed by the sheet feed rollers 252*a*, the output of the sheet feed sensor 45*a* is switched ON from OFF.

The middle and the lower sheet feed trays 25*b* and 25*c* are also respectively provided with sheet feed sensors 45*b* and 45*c*.

A large number of sheets 2*d* can also be stacked and set on the manual feed tray 25*d*. The sheet 2*d* may be a long sheet which fits in none of the sheet feed trays 25*a* to 25*c*. The manual feed tray 25*d* has a pickup roller 251*d*, sheet feed rollers 252*d*, and a size sensor that also serves as an empty sensor. Thus, in the present embodiment, the manual feed tray 25*d* is provided with no sheet feed sensor.

In the following description, the sheet feed trays 25*a* to 25*c* and the manual feed tray 25*d* may be referred to as "tray 25" with no distinction from one another.

Referring back to FIGS. 1A and 1B, a conveyance path 30 through which the sheet 2 passes inside the image forming apparatus 1 includes sheet feed paths 31, 32, 33, and 34, corresponding to the four respective trays 25, and a common path 35. The sheet feed paths 31 to 34 are each a path through which only the sheet 2 picked up from the corresponding one of the trays 25 passes. On the other hand, the common path 35 is a path through which any of the sheets 2*a*, 2*b*, 2*c* and 2*d*, set to different trays 25, pass and thus is a path common to the four trays 25. In the present embodiment, the manual feed tray 25*d* is disposed above the upper sheet feed tray 25*a*. Thus, a path between a junction P4, at the end of the sheet feed path 34, and the discharge rollers 18 serves as the common path 35.

The image forming apparatus 1 is provided with a media sensor (sheet attribute sensor) 41 for identifying the type of the sheet 2, and sets a printing operation condition in accordance with the type determined based on an output from the media sensor 41, so that an appropriate image can be obtained.

The media sensor 41 is disposed at a position on the upstream side of the print position P6 on the common path 35. In particular, the position is between the timing rollers 15 and the junction P4.

With the media sensor 41 arranged on the common path 35, the types of the sheets 2*a*, 2*b*, 2*c*, and 2*d* can be identified with a single sensor regardless of the number of trays 25. Thus, downsizing and cost reduction can be achieved with the number of sensor reduced.

The media sensor 41 acquires information, used for identifying the type, from the sheet 2. For example, the media sensor 41 is a photosensor, which irradiates the sheet 2 moving toward the timing rollers 15 with detection light, and acquires an amount of the detection light received after passing through the sheet 2 as information for identifying the basis weight of the sheet 2. Then, a detection signal indicating this amount of received light is sent to the control circuit 100.

When starting the execution of the input print job, the image forming apparatus 1 selects one of the trays 25 based on what is designated by the job. For example, the tray 25 in which the sheet 2 corresponding to the output image size designated by the job is set is selected. Alternatively, when the tray 25 is designated by the job, the designated tray 25 is selected.

Then, when the type of the sheet 2 identified has been stored for the selected tray 25, the operation condition corresponding to the stored type is set. Then, the sheet 2 is picked up from the selected tray 25, and printing is performed based on the operation condition set. In this case, the identification of the type based on the output from the media sensor 41 can be omitted.

On the other hand, when the type of the sheet 2 has not been stored for the selected tray 25, the sheet 2 is picked up from the selected tray 25 and is conveyed to the timing rollers 15. During this process, the type of the sheet 2 is identified based on the output from the media sensor 41. Then, printing is performed with an operation condition corresponding to the identified type set. Considering the fact that the sheet 2 may be taken out from the tray 25 and another sheet 2 may be placed thereon, the information about the type of the sheet 2 stored is preferably reset once any one of the sheet feed tray 25*a* to 25*c* is drawn out or the sheet 2 is pulled out from the manual feed tray 25*d*. In a continuous print job, the type of the first sheet 2 is identified, and identification of the type of the second sheet 2 and after is omitted.

An "automatic mode" and a "manual mode" are set in the image forming apparatus 1. The former is for automatically identifying the type of the sheet 2 and setting the printing operation condition as described above, whereas the latter is for setting the operation condition in accordance with the type manually input by the user. The user can designate the type by performing the following operation.

In a state of waiting for an operation by the user, an initial screen 600 illustrated in FIG. 3A is displayed on an operation panel 1E. The user touches a sheet button 612 of the initial screen 600, and designates a desired tray 25 on a tray designation screen (not illustrated) displayed as a result of the touching. When the user designates the tray 25, a type designation screen 650 illustrated in FIG. 3B is displayed.

The type designation screen 650 includes an automatic mode selection button 661, a manual mode selection button 662, and type selection buttons 671 to 675. The type selection buttons 671 to 675 correspond to five types of plain paper, thick paper 1, thick paper 2, thick paper 3, and thick paper 4, classified based on the basis weight.

The user who wishes to designate the type touches the manual mode selection button 662 to designate the manual mode, and then touches one of the type selection buttons 671 to 675 to designate the type. When the automatic mode selection button 661 is touched with the manual mode set, the mode is switched to the automatic mode. This type of manual input can be individually performed for each of the four trays 25 including the manual feed tray 25*d*.

When the manual mode has been set for the tray 25 selected at the time of job execution, the image forming apparatus 1 does not identify the type. The operation condition in this case is an operation condition corresponding to the type specified by the user.

The operating condition is a combination of a plurality of operating condition values. The operating condition values include system speed, fixing temperature, secondary transfer output, fog margin, and the like.

The system speed is a condition for defining a conveyance speed of the sheet 2, a circumferential speed of the photoreceptor 4, a moving speed of the intermediate transfer belt 12, a target rotation speed of the polygon motor 63, and the like. The fixing temperature is the heating temperature of a fixing heater in the fixing device 17, and the secondary transfer output is the output voltage of a high-voltage power supply circuit that biases the secondary transfer roller 16. The fog margin is a condition for preventing fogging, and is a difference between the charging potential of the photoreceptor 4 and a developing DC output. The fogging is a phenomenon in which toner attaches to a background.

By the way, when the type of the sheet 2 is identified at the time of executing the print job, an electrophotographic process, which is an operation of preparing for image forming, is started up in parallel with the conveyance of the sheet 2 from the selected tray 25 to the sensor position at which the media sensor 41 is arranged. The startup includes motor control for making the polygon motor 63 transition from a stopped state or a decelerated state for stopping to a stable rotation state in which the polygon motor 63 stably rotates at a speed for image forming.

The image forming apparatus 1 is provided with a function of achieving swift transition to the stable rotation state with the speed corresponding to the identified type. The configuration and the operation of the image forming apparatus 1 will be described below while focusing on this function.

Figure 4:
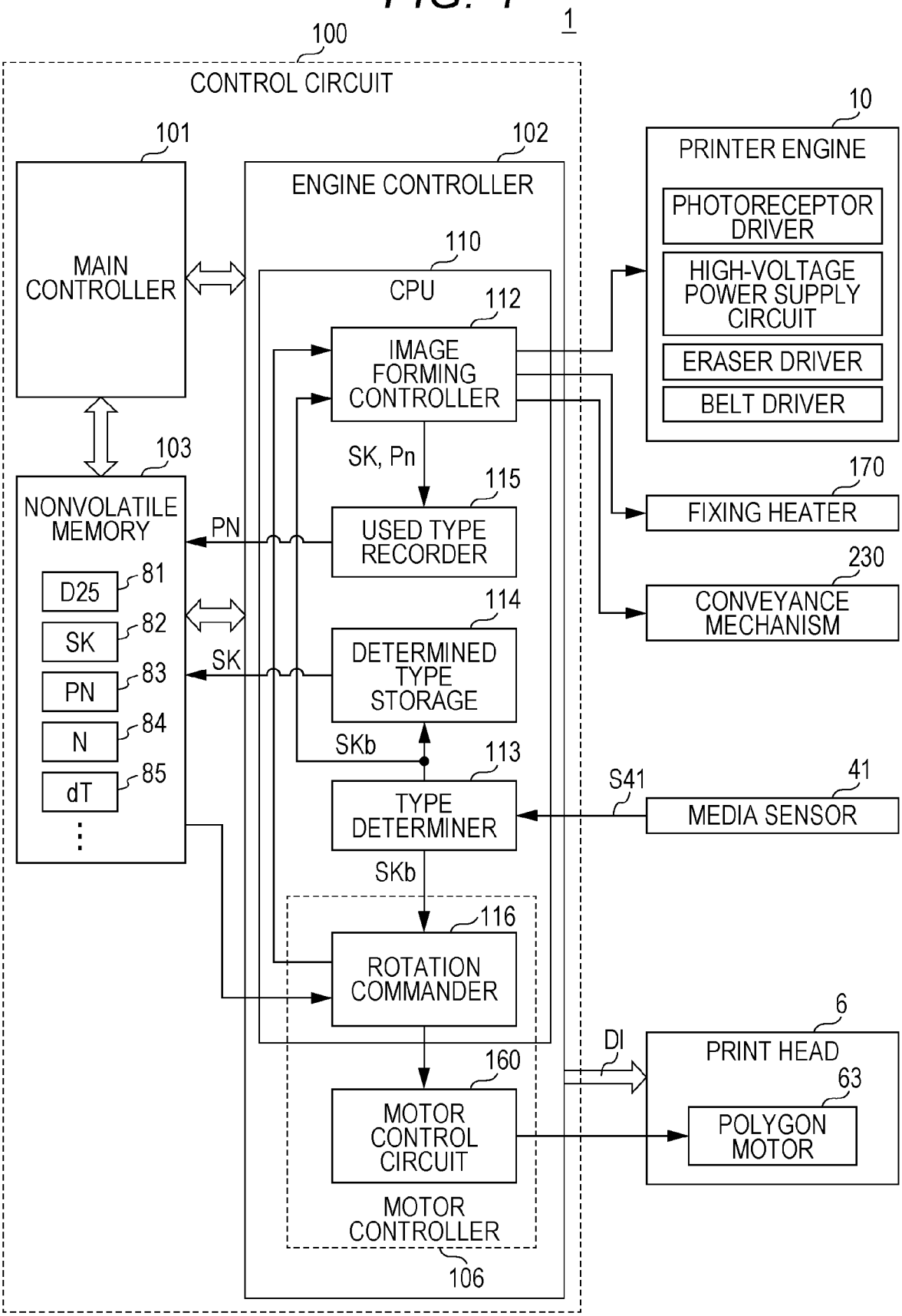
FIG. 4 is a diagram illustrating a configuration of a control circuit.
Figure 5:
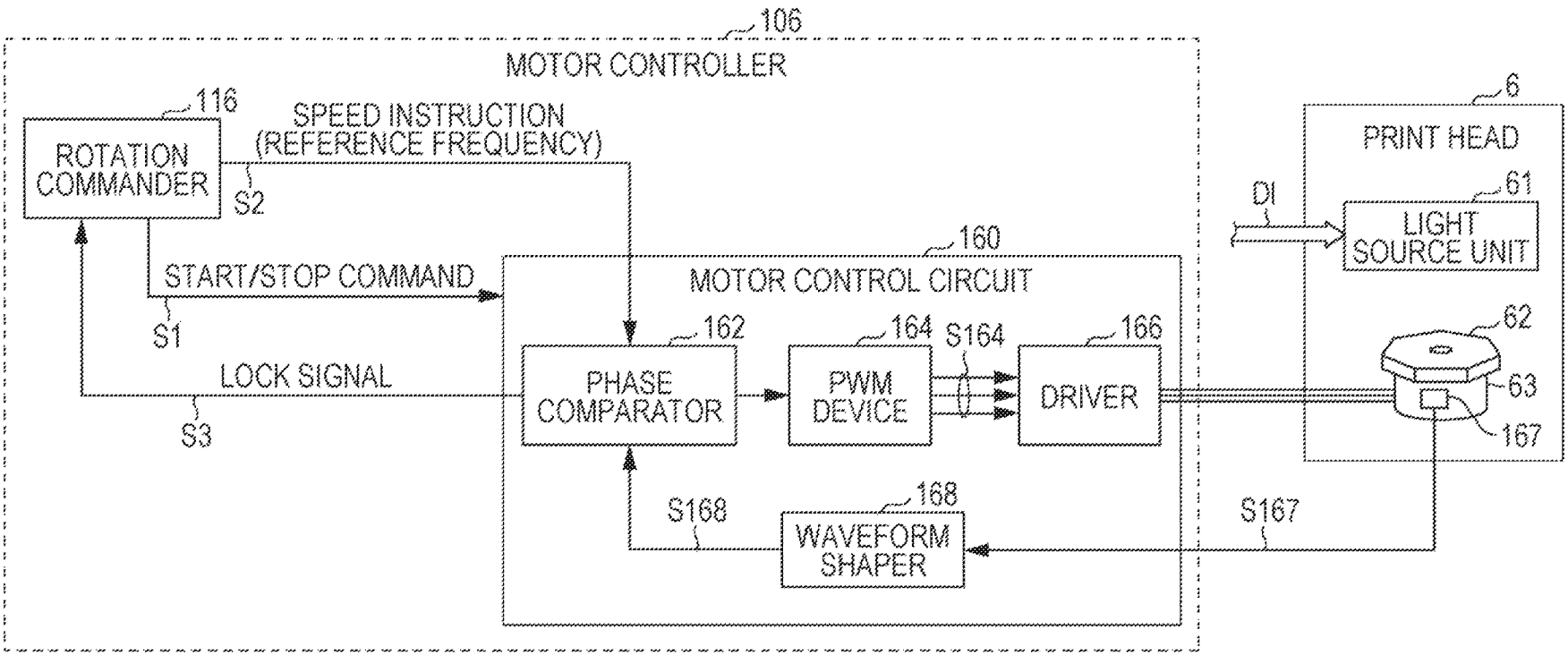
FIG. 5 is a diagram illustrating a configuration of a motor controller.

FIG. 4 illustrates a configuration of the control circuit 100. FIG. 5 illustrates a configuration of a motor controller 106. FIGS. 6A to 6C illustrate examples of tray information 81, a sheet determination table 82, and used type information 83. FIGS. 7A and 7B illustrate examples of a polygon speed table 84 and a startup setting table 85.

In FIG. 4, the control circuit 100 includes a main controller 101 in charge of controlling the entire image forming apparatus 1, an engine controller 102 mainly in charge of controlling the printer engine 10, a nonvolatile memory 103 that stores various types of control data, and the like.

When a print job is input through an operation using the operation panel 1E or through communications with an external host device, the main controller 101 refers to the tray information 81 stored in the nonvolatile memory 103, and selects the tray 25 to be used for the printing.

The tray information 81 is information indicating attribute data D25 for each of the four trays 25 as illustrated in FIG. 6A. The attribute data D25 includes a size SS detected for the sheet 2 being set, an orientation SD also detected, a type SK previously identified or designated by the user, and a type identification mode SKM.

The type identification mode SKM is automatic by default, and transitions to manual only when the user designate manual. As in the case of the sheet feed trays 25*a* and 25*c* in the example of FIG. 6A, the type SK may be null even if the type identification mode SKM is automatic. Specifically, this happens in a case where the tray 25 into which the sheet 2 has been set is unused with the type SK unidentified, and in a case where the tray 25 for which the identification has been made for a previous job is drawn out. When the tray 25 is drawn out, the type SK that has been stored is nullified, because the sheet 2 may be replaced to that of a different type SK.

Referring back to FIG. 4, when the type SK has been stored for the selected tray 25, the main controller 101 notifies the engine controller 102 of the stored type SK and instructs the engine controller 102 to perform predetermined control corresponding to the print job.

On the other hand, when the type SK has not been stored for the selected tray 25 the type identification mode SKM of which is automatic, the engine controller 102 is instructed to identify the type SK and then perform the print job.

The engine controller 102 includes a central processing unit (CPU) 110 that executes a control program and its peripheral devices (such as a read only memory (ROM) and a random access memory (RAM)). The engine controller 102 has functions such as an image forming controller 112, a type identifier 113, an identified type storage 114, a used type recorder 115, and a rotation commander 116. These functions are implemented by the hardware configuration of the engine controller 102 and by a control program executed by the CPU 110.

The image forming controller 112 controls the printer engine 10, a fixing heater 170, and a conveyance mechanism 230 that conveys the sheet 2. The control on the printer engine 10 and the fixing heater 170 includes startup control for achieving transition to a state where image forming can be performed. After the polygon motor 63 has been started up, the image forming controller 112 transfers print data DI to the print head 6 and causes the print head 6 to perform pattern exposure.

The type identifier 113 identifies the type SK of the sheet 2 picked up from the tray 25 and conveyed to the sensor position, based on a detection signal S41 output from the media sensor 41. Specifically, upon receiving an identification command, the main controller 101 acquires the detection signal S41 at a predetermined appropriate timing, and acquires an identification result which is the type SK corresponding to the value of the detection signal S41, from the sheet determination table 82 in which values of the detection signal S41 (a value obtained as the basis weight in the figure) are associated with the types SK as illustrated in FIG. 6B. Thus, the type SK of the sheet 2 is identified as any one of the plurality of types SK illustrated in the sheet determination table 82.

Then, the identified type storage 114, the image forming controller 112, and the rotation commander 116 are notified of the type SK thus determined as an identified type SKb.

The identified type storage 114 writes the notified identified type SKb in the nonvolatile memory 103, as the type SK in the tray information 81. This process corresponds to a process of storing the identified type SK.

The used type recorder 115 records the type SK of the sheet 2 used in the print job, so that the type SK of the sheet 2 frequently used by the user can be identified. Specifically, the used type information 83 stored in the nonvolatile memory 103 is updated as follows.

As shown in FIG. 6C, the used type information 83 is data indicating a total number of printed sheets PN which is a total value of the number of printed sheets Pn for each of a plurality of anticipated types SK. The used type recorder 115 acquires, for example, the type SK of the sheet 2 used in the current print job and the number of printed sheets Pn from the image forming controller 112. Then, the current value of the total number of printed sheets PN corresponding to the acquired type SK is replaced with a value obtained by adding the acquired number of printed sheets Pn to the current value.

Returning back to FIG. 4, the rotation commander 116 is a component of the motor controller 106 that controls the polygon motor 63. The motor controller 106 includes a rotation commander 116 and a motor control circuit 160.

As illustrated in FIG. 5, the rotation commander 116 provides a start/stop command S1 and a speed command S2 to the motor control circuit 160. The start/stop command S1 is a binary signal for causing the polygon motor 63 to start or stop rotating. The speed command S2 is a pulse train signal at a frequency corresponding to target rotation speed N (target speed) of the polygon motor 63, and provides a reference frequency of a phase lock loop (PLL) including the motor control circuit 160 and the polygon motor 63.

In the image forming apparatus 1, a three-phase DC brushless motor is used as the polygon motor 63. The polygon motor 63 has a frequency detection sensor 167 that outputs a frequency signal S167 corresponding to the rotation speed. The frequency detection sensor 167 includes, for example, a plurality of hall elements.

The motor control circuit 160 stably rotates the polygon motor 63 by PLL speed control. As the motor control circuit 160, a commercial integrated circuit for driving a three-phase DC brushless motor may be used.

The motor control circuit 160 includes a phase comparator 162, a PWM device 164, a driver 166, a waveform shaper 168, and the like. The frequency signal S167 from the polygon motor 63 is shaped by the waveform shaper 168 to be input to the phase comparator 162 as a Frequency Generator (FG) signal S168.

The phase comparator 162 outputs voltage corresponding to the phase difference between the speed command S2 from the rotation commander 13 and the FG signal S168.

The PWM device 164 generates a control signal S164 according to the value of the voltage input from the phase comparator 162. The control signal S164 is a signal for controlling the frequency and amplitude of the three-phase AC power supplied to the polygon motor 63 by pulse width modulation (PWM).

The driver 166 is a three-phase inverter that drives a rotor by supplying current to the coil of the polygon motor 63. The driver 166 turns ON and OFF the power supply to the polygon motor 63 based on the control signal S164. As a result the three-phase current flowing through the coil of the polygon motor 63 changes from moment to moment so that a rotating magnetic field is generated. The rotor rotates in synchronization with the rotating magnetic field.

The motor control circuit 160 accelerates the rotation when the phase of the speed command S2 leads the phase of the FG signal S168, that is, when the rotation speed of the polygon motor 63 is slower than the target speed. On the other hand, when the phase of the speed command S2 is behind the phase of the FG signal S168, that is, when the rotation speed of the polygon motor 63 is faster than the target speed, the rotation is decelerated.

The phase comparator 162 inputs a lock signal S3 to the rotation commander 116 once a stable rotation state of the polygon motor 63 is established, that is, when a state where the phase of the speed command S2 and the phase of the FG signal S168 match continues for a period which is a predetermined times as long as the control cycle.

Upon receiving the lock signal S3, the rotation commander 116 immediately notifies the image forming controller 112 of the establishment of the stable rotation state of the polygon motor 63. The image forming controller 112 causes the print head 6 to start pattern exposure upon receiving this notification or after the reception.

As illustrated in FIG. 7A, in the polygon speed table 84, setting values determined in accordance with the types SK of the sheet 2 are stored for a plurality of items related to the polygon motor 63. The plurality of items includes system speed, printing resolution, and a target rotation speed N. The types SK are classified into a plurality of type groups SKG1 to SKG3 according to similarities and differences among corresponding setting values.

The image forming apparatus 1 has a normal mode for printing at 600 dpi (normal resolution) and a high resolution mode for printing at 1200 dpi. The user can designate the normal mode or the high resolution mode for each print job. The normal mode is set by default.

In the normal mode, the system speed is switched according to the type SK of the sheet 2 to be used. The fastest speed (325 mm/s) among the options is set when printing a monochrome image on plain paper, and the second fastest speed is set when printing a color image on plain paper. The third fastest speed is set when printing is performed on thick paper 1 or 2, and the slowest speed (108.3 mm/s) is set when printing is performed on thick paper 3 or 4, regardless of whether the printing color is monochrome or color. With the system speed slowed down, the sheet 2 takes a longer time to pass through the fixing device 17, so that the thick sheet 2 can be sufficiently heated, whereby good fixing can be achieved.

In the high resolution mode, regardless of the type SK of the sheet 2, the slowest system speed among the options is set.

The target rotation speed N is uniquely determined based on the resolution and the system speed. In other words, a different combination of the value of the resolution and the value of the system speed inevitably results in a different target rotation speed N. In the examples illustrated in FIGS. 7A and 7B, the target rotation speed N in the high resolution mode is set to be the highest target rotation speed N5. In the normal mode, the target rotation speed N is the second fastest rotation speed N4 when a monochrome image is printed onto plain paper belonging to the type group SKG1, and is the third fastest rotation speed N3 when a color image is printed onto such paper. Furthermore, in the normal mode, the target rotation speed N is the fourth fastest rotation speed N2 when printing is performed on the thick paper 1 or 2 belonging to the type group SKG2, and is the slowest target rotation speed N1 when printing is performed on the thick paper 3 or 4 belonging to the type group SKG3. The target rotation speeds N1 to N5 satisfy the relationship N5>N4>N3>N2>N1 in terms of speed.

Next, an operation of the motor controller 106 will be described in more detail assuming a case where the type SK is identified when executing a print job.

In the print job in the normal mode, the rotation commander 116 supplies a provisional target rotation speed Na to the motor control circuit 160, when the polygon motor 63 is started up from the stopped state to be in the stable rotation state. The motor control circuit 160 drives the polygon motor 63 so that its rotation speed reaches the provisional target rotation speed Na.

When the sheet 2 is conveyed to the sensor position of the media sensor 41 and the type SK is determined, the rotation commander 116 reads the determined target rotation speed Nb, which is the target rotation speed N corresponding to the identified type SK, from the polygon speed table 84, and provides the determined rotation speed Nb to the motor control circuit 160. The motor control circuit 160 drives the polygon motor 63 such that its rotation speed reaches the determined target rotation speed Nb.

The provisional target rotation speed Na is the target rotation speed N determined for the type group SKG including the provisional type SKa, which is one of the five anticipated types SK. For example, when a provisional type SKa is set to the thick paper 1 belonging to the type group SKG2, the provisional rotation speed Na is the target rotation speed N2 associated with the type group SKG2 in the polygon speed table 84.

In the present embodiment, there are a fixed mode in which the provisional type SKa is a preidentified type SK, and a variable mode in which the provisional type SKa is appropriately changed in accordance with the user's use history.

For example, the provisional type SKa in the fixed mode is assumed to be the thick paper 3 or 4 belonging to the type group SKG3 corresponding to the slowest system speed. This setting is less likely to involve an occurrence of conveyance troubles such as slipping or paper jam, which is likely to occur when a thick sheet is conveyed at a fast speed.

In the variable mode, the provisional type SKa is set to be the type SK corresponding to the largest total printing number of sheets PN indicated by the used type information 83.

When the provisional type SKa is set to be plain paper, the provisional target rotation speed Na is determined based on a printing color designated in the print job. The rotation commander 116 sets the target rotation speed N4 to be the provisional rotation speed Na in a case of the monochrome printing, and sets the target rotation speed N3 to be the provisional rotation speed Na in a case of the color printing.

Note that, unlike in the print job in the normal mode, the target rotation speed N is set to be the target rotation speed N5 regardless of the type SK in a print job in the high resolution mode, and thus the polygon motor 63 needs not to be started up to be at the provisional rotation speed Na. Thus, in the print job in the high resolution mode, the rotation commander 116 provides the target rotation speed N5 to the motor control circuit 160 before the type SK is identified, without providing the provisional target rotation speed Na. Still, some of the operating conditions other than the target rotation speed N depend on the type SK. Thus, the type identifier 113 determines the type SK even in the case of the print job in the high resolution mode.

The provisional target rotation speed Na is equal to the determined target rotation speed Nb when the type SK identified belongs to the sample type group SKG as the provisional type SKa. In this case, the rotation commander 116 may provide the provisional target rotation speed Na to the motor control circuit 160 and provide no speed thereafter, or may provide the provisional target rotation speed Na again as the determined target rotation speed Nb.

On the other hand, when the identified type SK belongs to a type group SKG different from that including the provisional type SKa, the provisional target rotation speed Na and the determined target rotation speed Nb are different from each other. Thus, in this case, the startup control for the polygon motor 63 includes switching the target rotation speed N at the timing when the type SK is identified.

Combinations of the target rotation speed N (provisional target rotation speed Na) before the switching and the target rotation speed N (determined target rotation speed Nb) after the switching include 10 combinations denoted with numbers 1 to 10 in a startup setting table 85 in FIG. 7B. The combinations denoted by the numbers 1 to 5 are each a combination in which the determined target rotation speed Nb is higher than the provisional target rotation speed Na (Na<Nb). The combinations denoted by the numbers 6 to 10 are each a combination in which the determined target rotation speed Nb is lower than the provisional target rotation speed Na (Na>Nb).

In the startup setting table 85, the combinations denoted by the numbers 1 to 5 are divided into two groups according to similarities and differences in the provisional target rotation speeds Na, and the combinations denoted by the numbers 6 to 10 are similarly divided into three groups. A startup shift time dT is determined and associated with each of the four trays 25 in each of the total of five groups.

The startup shift time dT is a control parameter that defines a timing (startup timing) t2 at which the startup for causing rotation at the provisional target rotation speed Na starts, as described below.

Figure 8:
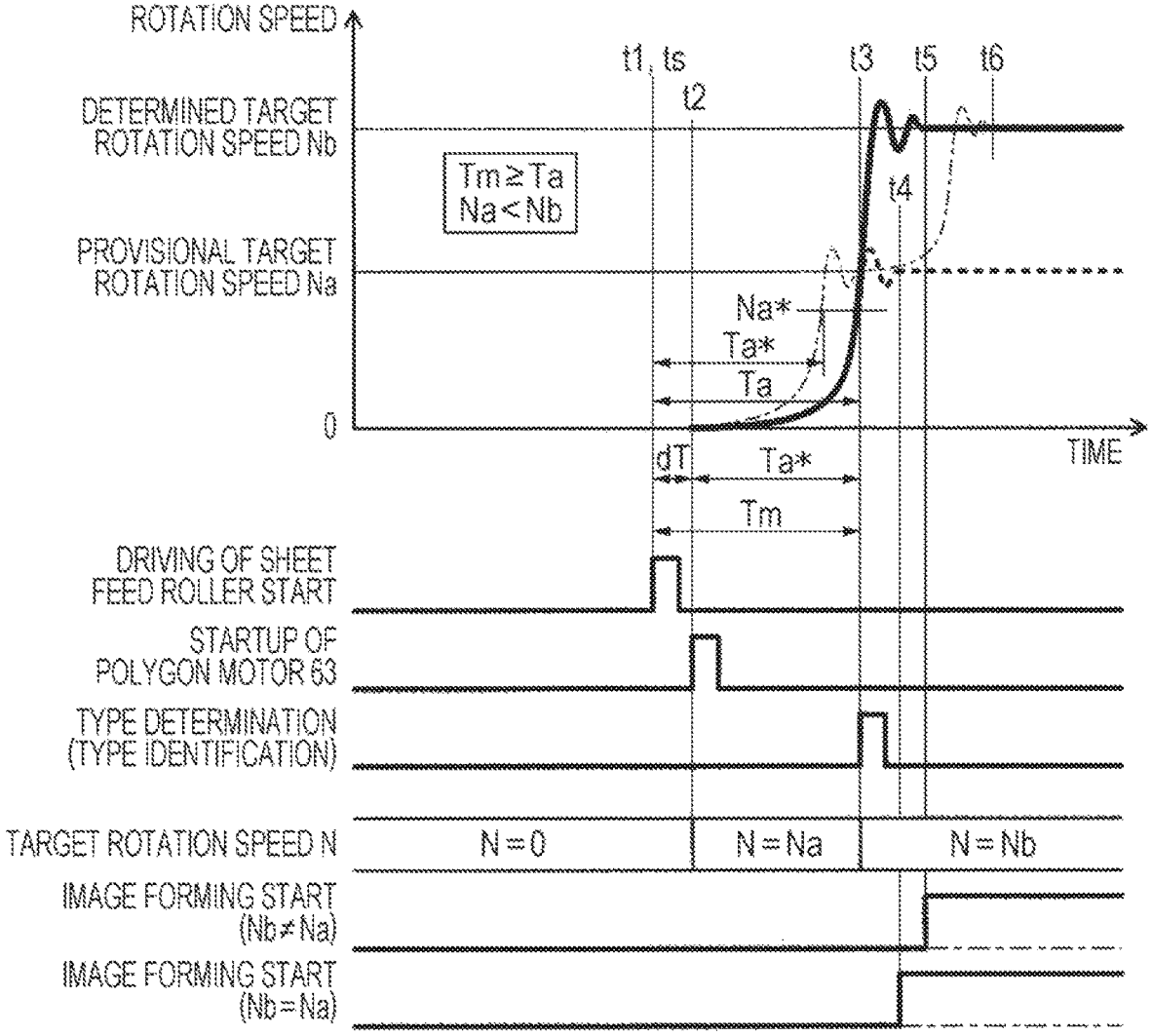
FIG. 8 is a diagram illustrating a first example of startup of a polygon motor.
Figure 9:
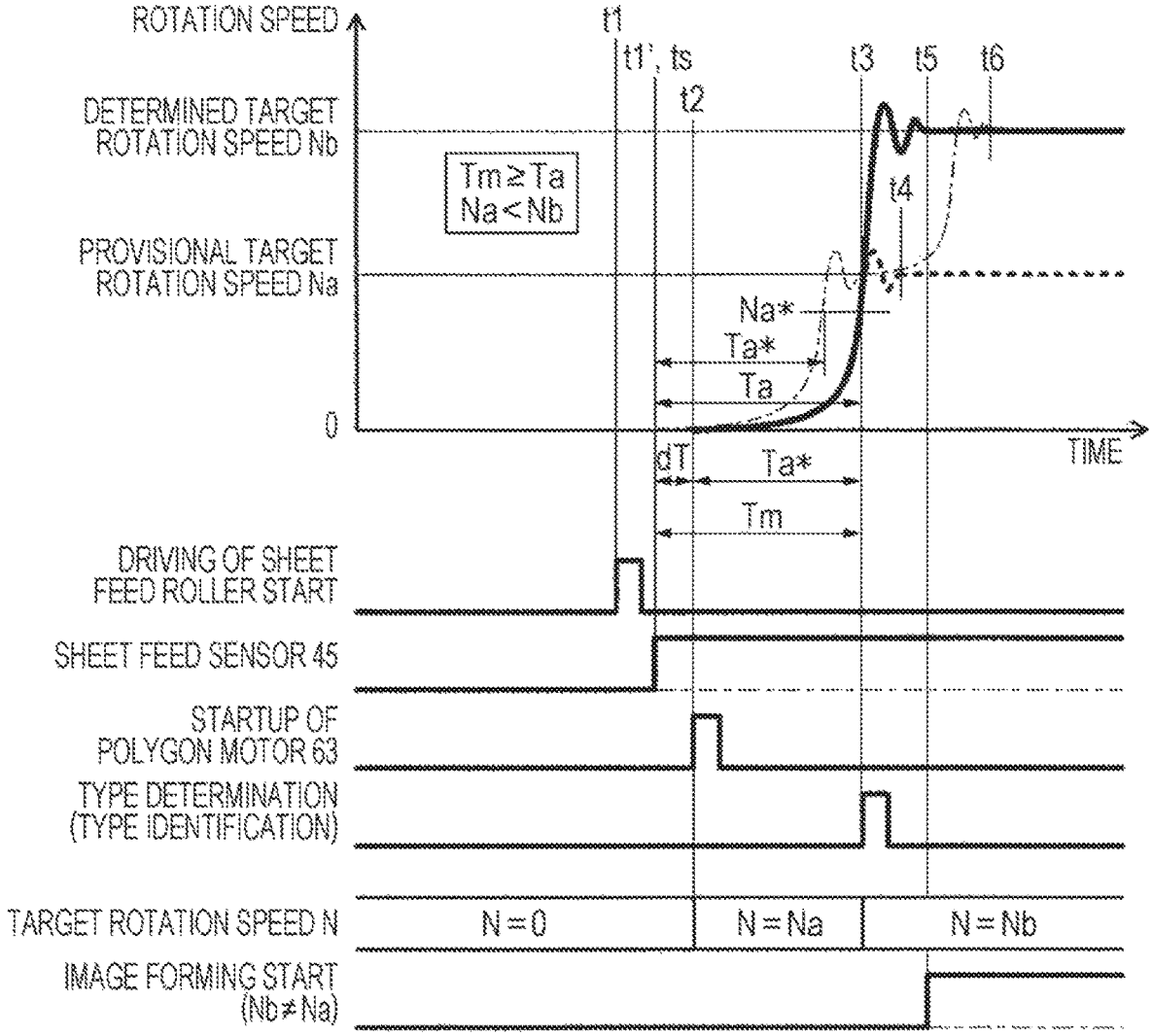
FIG. 9 is a diagram illustrating a second example of the startup of the polygon motor.
Figure 10:
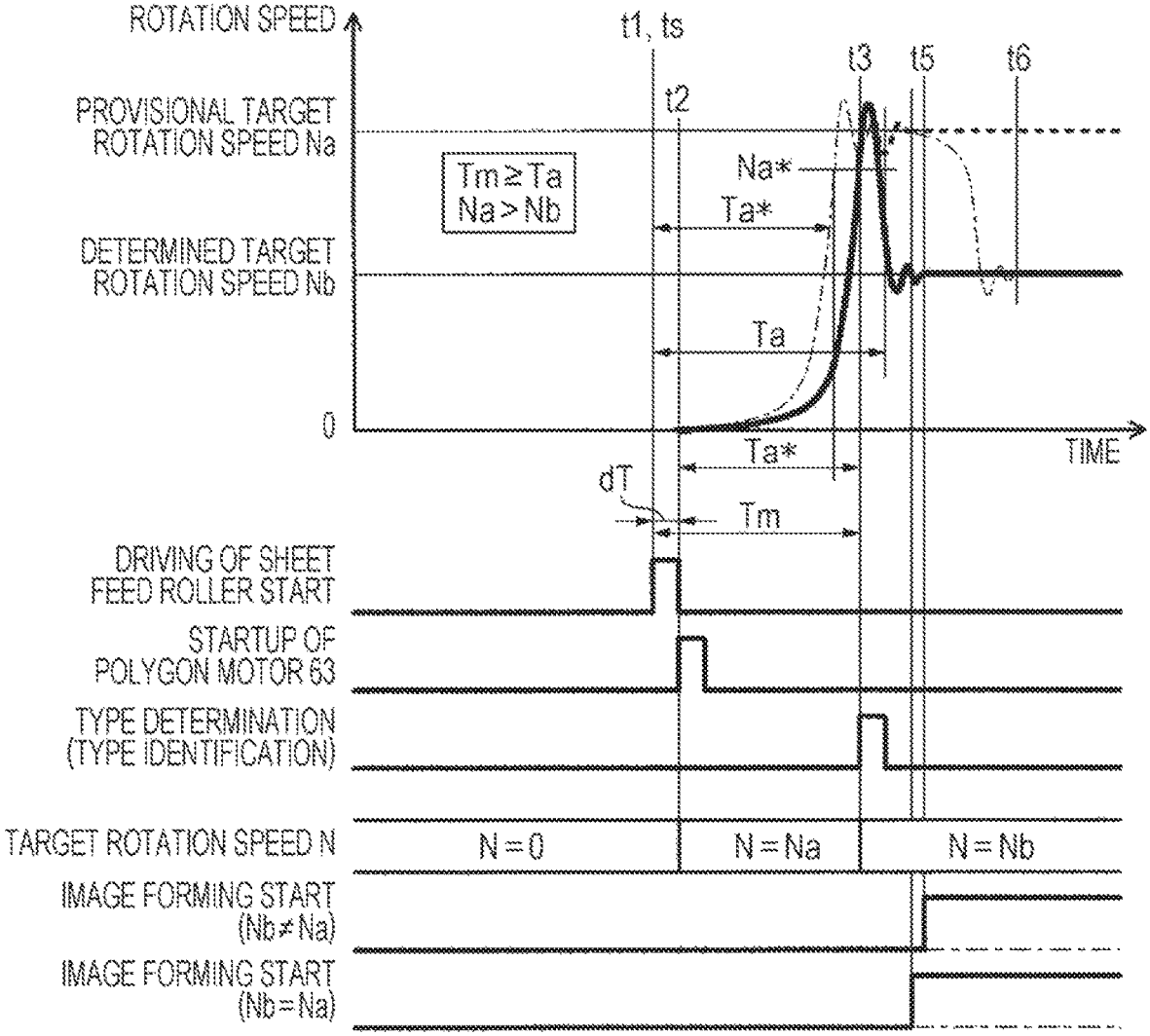
FIG. 10 is a diagram illustrating a third example of the startup of the polygon motor.

FIG. 8 illustrates a first example of the startup for the polygon motor 63, and FIGS. 9 and 10 respectively illustrate second and third examples of the same. In these first to third examples, the following Formula (1) is assumed to be satisfied.

$$Tm \geq Ta \quad (1)$$

In Formula (1). Tm is a time between the start of conveyance of the sheet 2 and the identification of the type SK (required identification time). Furthermore, Ta is a time (provisional startup time) required for the polygon motor 63 in the stopped state to transition to the stable rotation state with the provisional target rotation speed Na.

The required identification time Tm, which is constant for each tray 25, is a sum of a conveyance time, corresponding to a distance between the position set to be the conveyance starting point and the media sensor 41, and a processing time required for the type identifier 113 to identify the type SK based on the detection signal S41. The conveyance starting point is, for example, a nip between the sheet feed rollers 252 or a detection position at which the sheet feed sensor 45 is disposed.

The provisional startup time Ta is determined mainly based on the characteristics of the polygon motor 63 and the specification of the polygon mirror 62 as a rotational load. Note that the time may be somewhat affected by a change in environmental conditions (motor temperature in particular).

The first example illustrated in FIG. 8 is an example where the provisional target rotation speed Na ends up being lower than the determined target rotation speed Nb (Na<Nb). Thus, the target speed is switched from a low speed to a high speed in the middle of the startup control.

In the first example, the conveyance start timing ts is a timing t1 at which the sheet feed roller 252 starts to be driven.

The timing t1 is synchronized with a timing of turning ON the start key 151 in a copy job. Thus, when the user presses the start key 151, conveyance of a document by the auto document feeder 1A starts, and at the same time or after that, the sheet feed rollers 252 start to be driven.

Also for box printing, the timing t1 is synchronized with the timing of turning ON the start key 151.

For PC printing and facsimile reception, timing t1 is synchronized with a timing at which the start of job execution is determined in the main controller 101.

The type SK of the sheet 2 is identified at a timing t3 later than the timing t1 by the required identification time Tm. Thus, the type SK of the fed sheet 2 is identified, and then the determined target rotation speed Nb is determined.

At a timing t2 between the timing t1 and the timing t3, the startup of the polygon motor 63 starts. The target rotation speed N at this timing is the provisional target rotation speed Na. Thus, at the timing t2, the rotation commander 116 provides the provisional target rotation speed Na to the motor control circuit 160, and the polygon motor 63 starts to be driven.

The timing t2 (startup timing) is determined such that the tinting t3 at which the type SK is identified can be a timing within a period during which the rotation speed of the polygon motor 63 changes from 0 to the provisional target rotation speed Na. Specifically, the timing t2 is determined to be earlier than the timing t3 by a time Ta* required for the rotation speed to change from 0 to a rotation speed Na* (70 to 90% of the provisional target rotation speed Na, for example) lower than the provisional target rotation speed Na.

Since the time Ta* cannot be traced back in the actual control, the time Ta* is obtained in advance, for example, by experiment, and the difference between the required identification time Tm and the time Ta* is calculated as the startup shift time dT to be stored in the startup setting table 85 described above.

The motor controller 106 reads out the startup shift time dT corresponding to the provisional type SKa from the startup setting table 85 in a timely manner, and starts the startup of the polygon motor 63 at the timing t2 which is later than the timing t1 by the startup shift time dT.

Then, at the timing t3 at which the type SK is identified, the motor controller 106 switches the target rotation speed N from the provisional target rotation speed Na to the determined target rotation speed Nb and continues the startup. Thereafter, when the stable rotation state with the determined target rotation speed Nb is established at a timing t5, the polygon motor 63 is controlled so that the stable rotation state is maintained.

On the other hand, if the target rotation speed N is switched to the determined target rotation speed Nb after the polygon motor 63 has reached the stable rotation state with the provisional target rotation speed Na, the completion of the startup will be delayed. This is described in detail below.

When the startup of the polygon motor 63 starts at the timing t1 at which the conveyance of the sheet 2 starts, the rotation speed Na* is achieved at a timing earlier than the timing 13, as shown by a one dot dashed line curve in the figure. In the example illustrated in FIG. 8, the required identification time Tm and the provisional startup time Ta are the same (Tm=Ta), and the stable rotation state with the provisional target rotation speed Na is established at the timing t3. Once the stable rotation state is established, it becomes difficult to change the rotation speed due to the inertia of the polygon mirror 62. For this reason, even though the timing t3 at which the target rotation speed N switches is the same, the stable rotation state with the determined target rotation speed Nb is established at a timing t6 later than the timing t5.

In other words, with the startup of the polygon motor 63 intentionally delayed by the startup shift time dT to start at the timing t2, the startup can be completed earlier.

The startup shift time dT may be optimized so that the timing t5 arrives at the earliest possible time point. When the target rotation speed N is switched at the timing t3, the rotation speed preferably increases smoothly without disturbance, for the sake of swift startup.

For example, when the provisional target rotation speed Na is the target rotation speed N1, the target rotation speed N2, N3, or N4 may be the determined target rotation speed Nb. Thus, when the optimum value of the startup shift time dT is different among a plurality of target rotation speeds N that can be the determined target rotation speed Nb, the average value of these optimum values or any one of these optimum values may be stored in the startup setting table 85. An optimum value corresponding to the target rotation speed N that is likely to be the determined target rotation speed Nb may be stored in the startup setting table 85, based on results of investigation on the use situation conducted with many users.

At the timing t5, the image forming (electrophotographic process) can be started, if the startup of a component other than the polygon motor 63 such as the photoreceptor 4 has also been completed. Furthermore, when the provisional target rotation speed Na and the determined target rotation speed Nb are the same, the stable rotational state of the polygon motor 63 with the provisional target rotation speed Na can be established at a timing t4 as indicated by a bold line in the figure.

The second example illustrated in FIG. 9 is also an example where the provisional target rotation speed Na ends up being lower than the determined target rotation speed Nb (Na<Nb).

In the second example, the conveyance start timing ts is a timing t1' at which the sheet feed sensor 45 is turned ON. Thus, the timing t3 at which the type SK is identified is a timing later than this timing t1' by the required identification time Tm.

Unlike the manual feed tray 25*d*, the sheet feed trays 25*a* to 25*c* are provided with the paper feed sensors 45*a* to 45*c* (see FIG. 2), and thus the timing t3 can be identified from the timing t1' and the required identification time Tm as described above.

With the timing t1' used for identifying the timing t3, the timing t2 can be determined as a timing earlier than the timing t3 by the time Ta* more accurately than the first example employing the timing t1 at which the sheet feed roller 252 starts to be driven.

The time between the timing t1' and the timing t3 might vary due to slipping of the sheet feed rollers 252 or variation in the leading end position of the sheet 2 in the state of being set in the tray 25.

On the other hand, the time between the timing t1' and the timing t3 is unaffected by the slipping of the sheet feed roller 252 or the variation in the leading end position of the sheet 2.

The second example is the same as the first example described above except that the conveyance start timing ts is the timing t1'.

The third example illustrated in FIG. 10 is an example where the provisional target rotation speed Na ends up being higher than the determined target rotation speed Nb (Na>Nb). Thus, the target speed is switched from a high speed to a low speed in the middle of the startup control.

In the third example, the conveyance start timing ts is the timing t1 at which the sheet feed rollers 252 start to be driven, as in the first example. Alternatively, the conveyance start timing ts may be the timing t1' at which the sheet feed sensor 45 is turned ON, as in the second example.

The motor controller 106 starts the startup of the polygon motor 63 at the timing t2 that is later than the timing t1 by the startup shift time dT, as in the first example. Then, at the timing t3 at which the type SK is identified, the motor controller 106 switches the target rotation speed N from the provisional target rotation speed Na to the determined target rotation speed Nb lower than the provisional target rotation speed Na, and continues the startup. Thereafter, when the stable rotation state with the determined target rotation speed Nb is established at a timing t5, the polygon motor 63 is controlled so that the stable rotation state is maintained.

On the other hand, when the startup of the polygon motor 63 starts at the timing t1, the startup is completed at the timing t6 later than the timing t5, as indicated by a one dot dashed line curve in the figure. This is because the stable rotation state with the determined target rotation speed Nb has been established at the timing t3 at which the target rotation speed N is switched, making it difficult to change the rotation speed due to the inertia of the polygon mirror 62, as in the first example.

Figure 11:
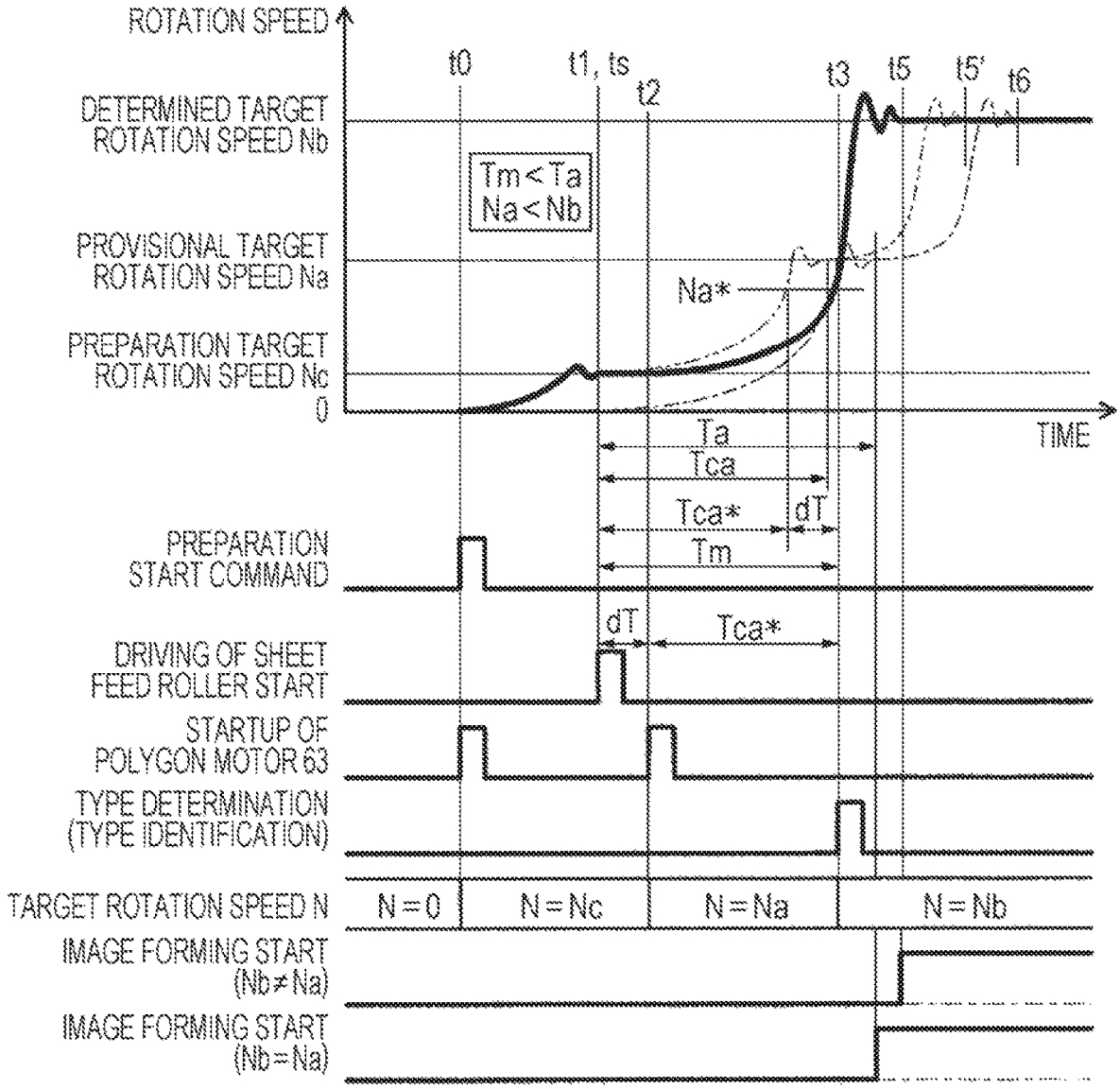
FIG. 11 is a diagram illustrating a fourth example of the startup of the polygon motor.

FIG. 11 illustrates a fourth example of the startup of the polygon motor 63. In this fourth example, a case is assumed where the above-described Formula (1) is not satisfied, that is, the required identification time Tm is shorter than the provisional startup time Ta (Tm<Ta). For example, the formula (1) may fail to be satisfied when the sheet 2 is conveyed to the media sensor 41 at a high speed.

The motor controller 106 performs the startup at a timing t0 at which a preparation start command is issued to the engine controller 102, so that the polygon motor 63 in the stopped state rotates at a preparation target rotation speed Nc lower than the provisional target rotation speed Na.

The main controller 101 issued the preparation start command when a predetermined state change occurs in the image forming apparatus 1. Examples of the cause of the issuing include a certain operation performed on the operation panel 1E by the user, detection of the user approaching by a human sensor, and access from an external device, as well as a prospect of a print job being input in the near future.

After the rotation speed of the polygon motor 63 has reached the preparation target rotation speed Nc, the conveyance of the sheet 2 starts. The motor controller 106 performs the startup at the timing t2 later than the conveyance start timing ts (t1 or t1') by the startup shift time dT, for causing the polygon motor 63, rotating at the preparation target rotation speed Nc, to rotate at the provisional target rotation speed Na.

The startup shift time dT in the fourth example is a difference between a time Tca*, shorter than a time Tca, and the required identification time Tm.

The time Tca is a time (shortened provisional startup time) required for the polygon motor 63 to transition from the state of rotating at the preparation target rotation speed Nc to the stable rotation state with the provisional target rotation speed Na, and is shorter than the provisional startup time Ta. The time Tca* is a time required for the rotation speed of the polygon motor 63 to change from the preparation target rotation speed Nc to a rotation speed Na* (which is 70 to 90% of the provisional target rotation speed Na, for example) between the preparation target rotation speed Nc and the provisional target rotation speed Na.

Thus, the timing t3 at which the type SK is identified is a timing at which the rotation speed reaches the rotation speed Na*, that is, a timing within a period over which the rotation speed changes to the provisional target rotation speed Na.

At this timing t3, the motor controller 106 switches the target rotation speed N from the provisional target rotation speed Na to the determined target rotation speed Nb. With the switching thus performed while the rotation speed is changing, the timing t5 at which the stable rotation state with the determined target rotation speed Nb is established is earlier than that in the case that the switching is performed in the stable rotation state.

A one dot dashed line curve in the figure indicates how the rotation speed transitions in the case that the startup is performed to achieve the provisional target rotation speed Na from the stopped state at the timing t1 with no startup performed to achieve the preparation target rotation speed Nc. In this case, the stable rotation state with the determined target rotation speed Nb is established at the timing t6, after the target rotation speed N has been switched at the timing t3.

A two dot dashed line curve in the figure indicates how the rotation speed transitions in the case that the startup to achieve the preparation target rotation speed Nc is performed at the timing t0 and then the startup to achieve the provisional target rotation speed Na from the preparation target rotation speed Nc is performed at the timing t1 instead of the timing t2. In this case, after the target rotation speed N has been switched at the timing t3, the stable rotational state with the determined target rotation speed Nb is established at a timing t5' earlier than the timing t6. Still, it is later than the timing t5.

Figure 12:
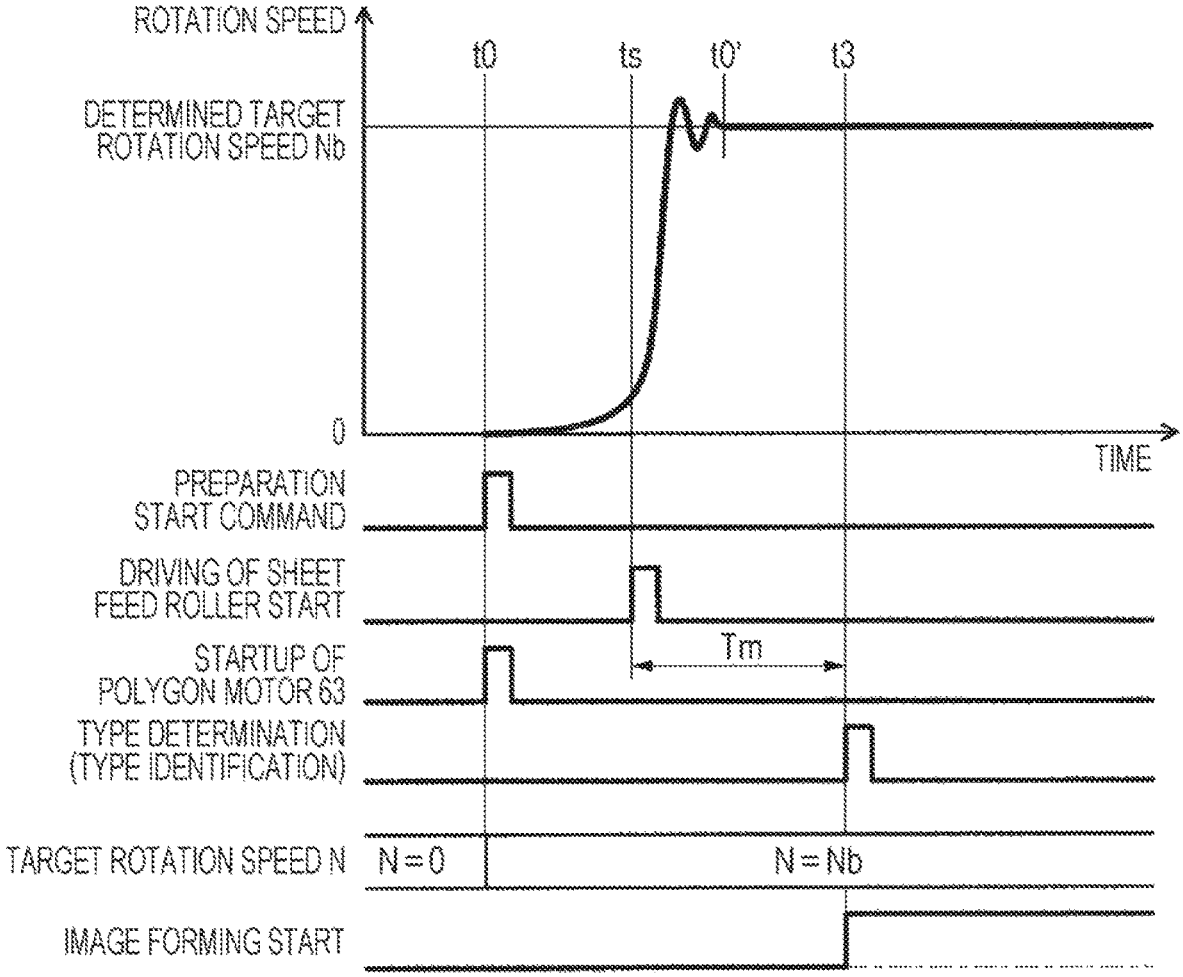
FIG. 12 is a diagram illustrating a fifth example of the startup of the polygon motor.

FIG. 12 illustrates a fifth example of the startup of the polygon motor 63. The fifth example is an example of a case where the determined target rotation speed Nb has been identified before the sheet 2 starts to be conveyed.

At the timing t0 at which the preparation start command is issued, the motor controller 106 performs the startup for causing the polygon motor 63 in the stopped state to rotate at the determined target rotation speed Nb. When the stable rotation state with the determined target rotation speed Nb is established at a timing t0', the polygon motor 63 is controlled so that this state is maintained.

The type SK may be identified to confirm whether the determined target rotation speed Nb is correctly determined. In such a case, the sheet 2 starts to be conveyed at the timing ts, and the type SK is identified at the timing t3 thereafter.

Figure 13:
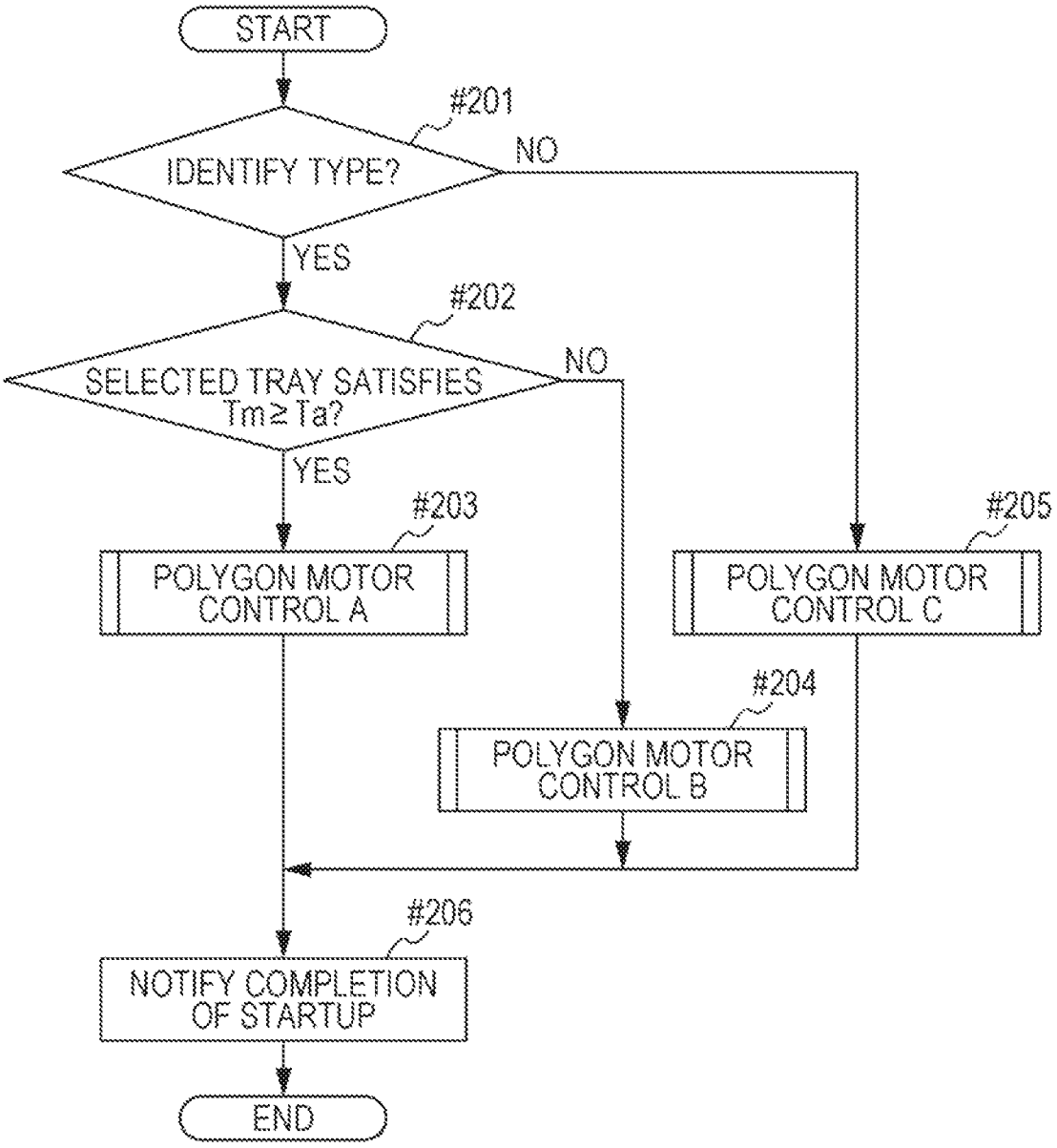
FIG. 13 is a diagram illustrating a flow of startup processing in the motor controller.
Figure 14:
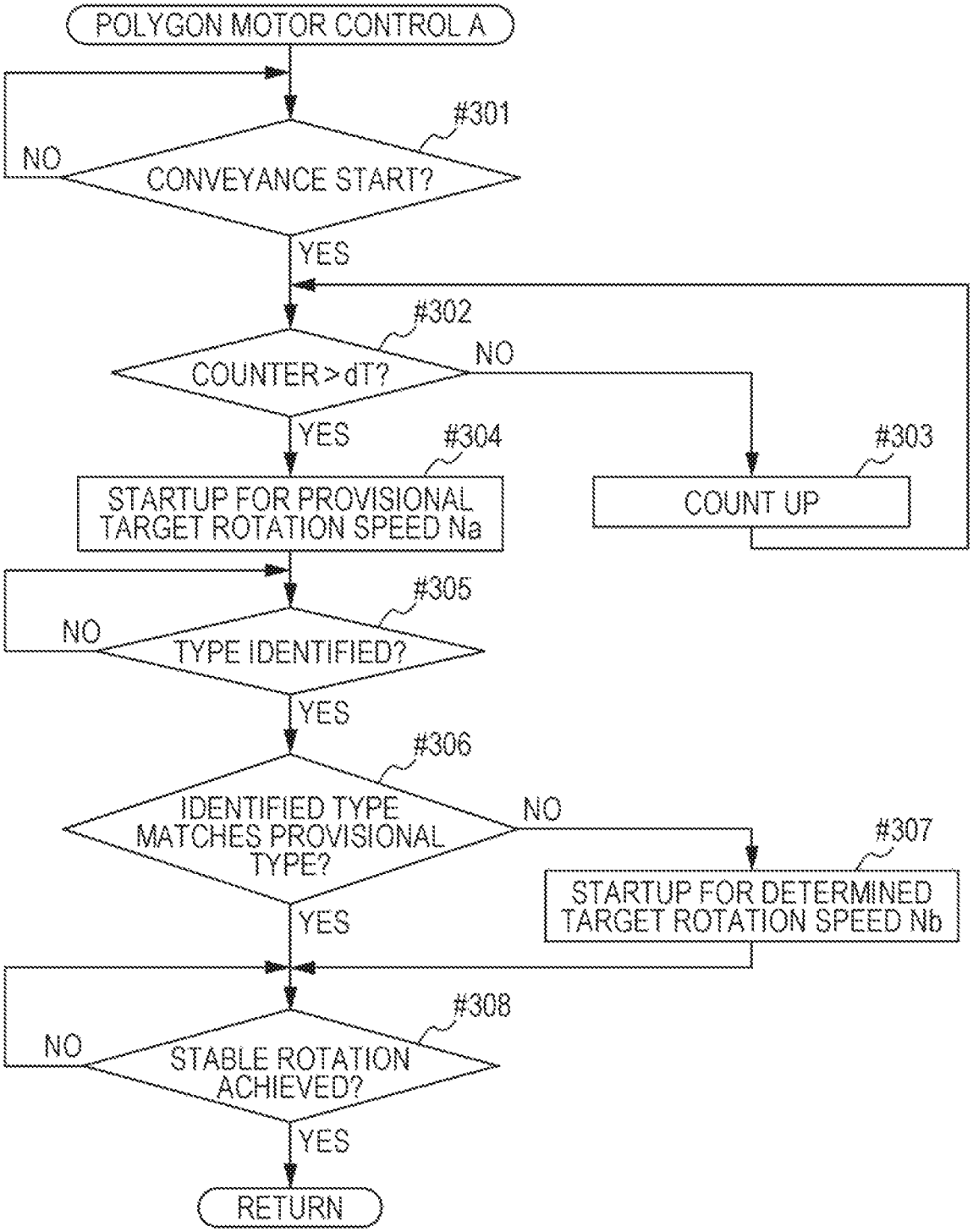
FIG. 14 is a diagram illustrating a flow of processing of polygon motor control A.
Figure 15:
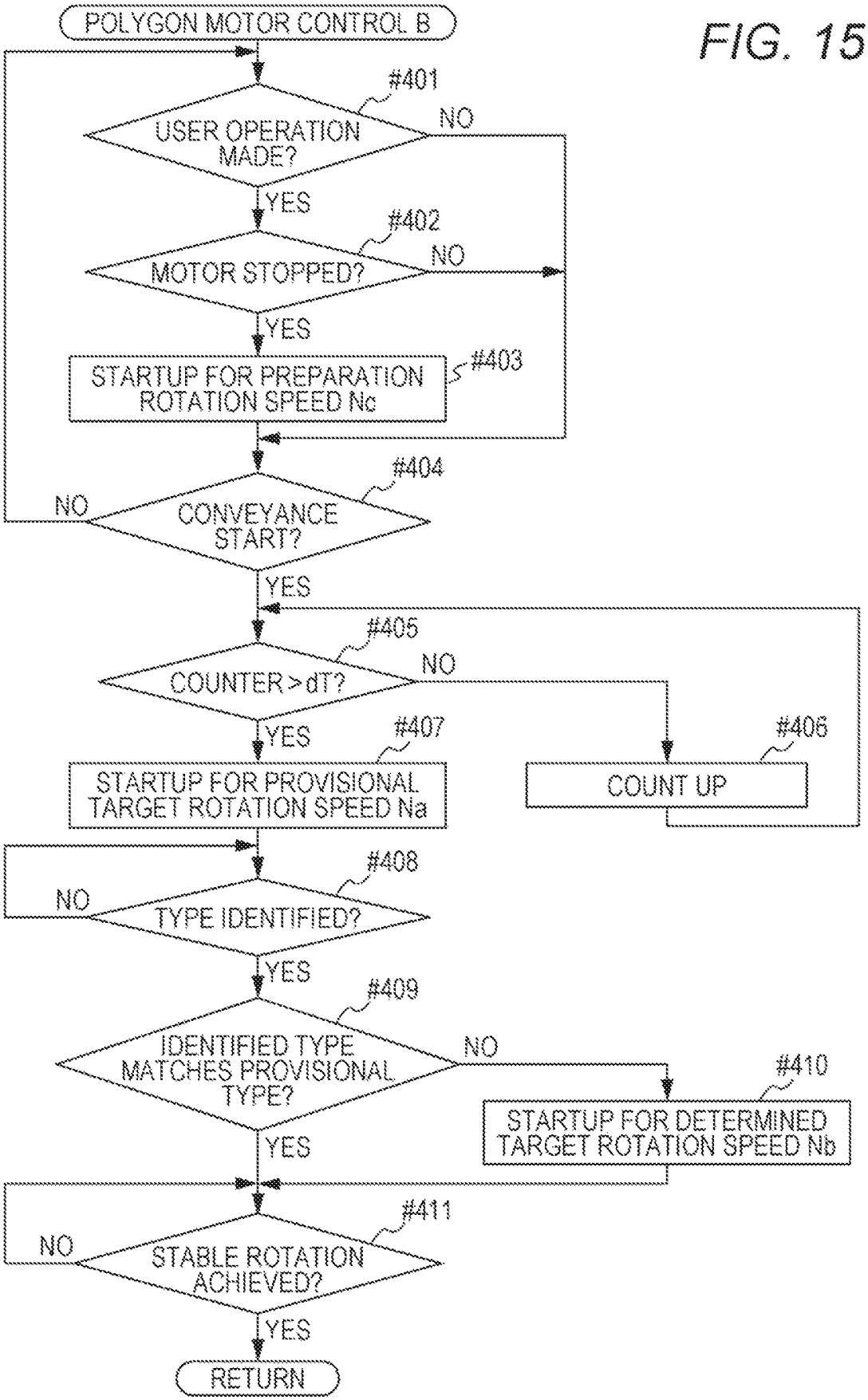
FIG. 15 is a diagram illustrating a flow of processing of polygon motor control B.
Figure 16:
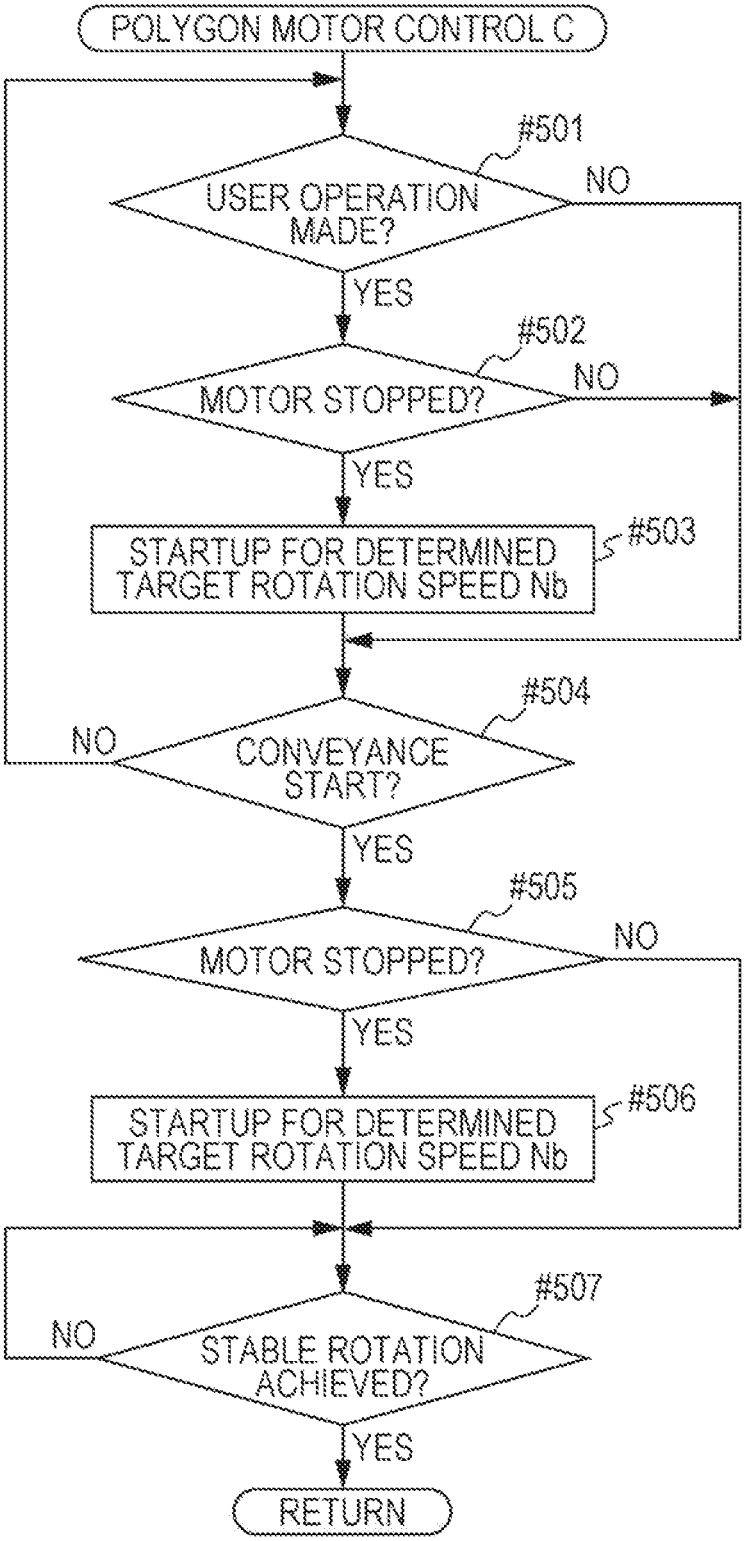
FIG. 16 is a diagram illustrating a flow of processing of polygon motor control C.

FIG. 13 illustrates a flow of startup processing by the motor controller 106. FIG. 14 illustrates a flow of processing of polygon motor control A. FIG. 15 illustrates a flow of processing of polygon motor control B. FIG. 16 illustrates a flow of processing of polygon motor control C.

In FIG. 13, whether the type SK of the sheet 2 is to be identified is checked in order to determine the determined target rotation speed Nb (#201).

When the type SK is not to be identified (NO in #201), the polygon motor control C is executed (#205), and the image forming controller 112 is notified of the startup completion (#206).

When the type SK is to be identified (YES in #201), whether the image forming apparatus 1 satisfies Formula (1) for the selected tray 25, that is, whether Tm>Ta holds true is checked (#202).

When Formula (1) is satisfied (YES in #202), the polygon motor control A is executed (#203), and the image forming controller 112 is notified of the startup completion (#206). When Formula (1) is not satisfied (NO in #202), the polygon motor control B is executed (#204), and the image forming controller 112 is notified of the startup completion (#206).

As illustrated in FIG. 14, the polygon motor control A waits for the arrival of the conveyance start timing is such as turning ON of the start key 151 (#301).

When the start timing is arrives (YES in #301), a counter measures the startup shift time dT (#302, #303).

When the time measurement is completed (YES in #302), the polygon motor 63 is started up for the provisional target rotation speed Na (#304), and the control waits for the type SK of the sheet 2 to be identified (#305).

When the type SK is identified (YES in #305), whether the identified type SK matches the provisional type SKa is checked (#306).

When the identified type SK matches the provisional type SKa (YES in #306), the control waits for the stable rotation to be achieved (#308), and then returns to the flow in FIG. 13. When the types do not match (NO in #306), the target rotation speed N is switched to the determined target rotation speed Nb (#307). Also in this case, the control waits for the stable rotation to be achieved (#308), and then returns to the flow in FIG. 13.

As illustrated in FIG. 15, in the polygon motor control B, whether a certain user operation has been performed before the conveyance start tinting ts arrives (NO in #404) is checked (#401).

When the certain user operation has been performed (YES in #401) with the polygon motor 63 stopped (YES in #402), the polygon motor 63 is started up for the preparation target rotation speed Nc (#403).

When the start timing ts arrives (YES in #404), a counter measures the startup shift time dT (#405, #406).

When the time measurement is completed (YES in #405), the polygon motor 63 is started up for the provisional target rotation speed Na (#407), and the control waits for the type SF of the sheet 2 to be determined (#408).

When the type SF is determined (YES in #408), whether the identified type SK matches the provisional type SKa is checked (#409).

When the identified type SK matches the provisional type SKa (YES in #409), the control waits for the stable rotation to be achieved (#411). When the types do not match (NO in #409), the target rotation speed N is switched to the determined target rotation speed Nb (#410), and then the control waits until stable rotation is achieved (#411). When the stable rotation is achieved (YES in #411), the control returns to the flow in FIG. 13.

As illustrated in FIG. 16, in the polygon motor control C, whether a certain user operation has been performed before the conveyance start timing ts arrives (NO in #504) is checked (#501).

When the certain user operation has been performed (YES in #501) with the polygon motor 63 stopped (YES in #502), the polygon motor 63 is started up for the determined target rotation speed Nb corresponding to the selected tray 25 (#503).

When the start timing ts arrives (YES in #504), whether the polygon motor 63 is stopped is checked (#505). When the polygon motor 63 is stopped (YES in #505), the polygon motor 63 is started up for the determined target rotation speed Nb corresponding to the selected tray 25 (#506). Then, when the stable rotation is achieved (YES in #507), the control returns to the flow in FIG. 13.

According to the above embodiment, the startup can be swiftly performed, with the type SK of the sheet 2 identified, for making the polygon mirror 62 to transition to a rotation speed with a speed corresponding to the type SK.

The startup starts before the type SK is identified, to be completed earlier than in the case that the startup starts after the type SK has been determined. Thus, image forming can be more swiftly started, whereby shorter FPOT can be achieved.

The startup is started so that the type SK is identified during the startup to achieve the provisional target rotation speed Na. Thus, the provisional target rotation speed Na can be switched to the determined target rotation speed Nb in the middle of the startup as necessary when the type SK is identified. The startup to achieve the determined target rotation speed Nb can be completed swiftly because the transition to the determined target rotation speed Nb is easier to be achieved with the inertial force, acting to maintain the rotation speed, being smaller than that in the case that the target rotation speed N is switched after the startup to achieve the provisional target rotation speed Na has been completed.

By rotating after the sheet 2 has been started to be conveyed, the polygon motor 63 can operate for a shorter period of time compared with a case where the polygon motor 63 rotates before the conveyance starts. Thus, a longer service life of the polygon motor 63 is achieved. Furthermore, the image forming apparatus 1 can operate while emitting a smaller amount of noise.

In the embodiment described above, the polygon motor 63 may be a motor rotation of which is characterized to be stable earlier with deceleration than with acceleration. In such a case, a time required for the startup for switching the target rotation speed N based on a result of identifying the type SK can be shortened with the provisional target rotation speed Na being the highest target rotation speed N of the target rotation speeds N corresponding to a plurality of respective types SK.

In the embodiment described above, the startup shift time dT may be adjusted in accordance with the temperature dependency or the time-dependent change of the rotation characteristic of the polygon motor 63. The temperature of the polygon motor 63 may be measured by a sensor, or may be estimated from a length of a period of the stopped state before the startup. A table in which the number of printing times and an adjustment amount of the startup shift time dT are associated with each other may be stored, and the startup shift time dT may be adjusted based on a count value of the number of printed times.

In the embodiment described above, the media sensor 41 is described as an optical sensor, but this should not be construed in a limiting sense. For example, the sensor can be changed to a sensor that can be used for identifying the type of the sheet 2 such as an ultrasonic sensor, a displacement sensor, a capacitance sensor, or a camera. Furthermore, a plurality of such sensors may be used.

In the embodiment described above, for the provisional target rotation speed Na, the mode in which a numerical value corresponding to the type SK determined in advance is used, and the mode in which a numerical value corresponding to the type SK determined in accordance with the user's history have been described. However, the modes should not be construed in a limiting sense. It may be an independent numerical value not depending on the type SK. The independent numerical value may be a machine-specific value. Furthermore, the user may be capable of directly setting the rotation speed.

Moreover, the overall configuration of each of the image forming apparatus 1 and the motor controller 106, configurations of parts of these, the content, order, and the timing of the processes, and the content of the information 81, 83 and the table 82, 84, 85 may be modified as appropriate without departing from the gist of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that conveys a sheet and prints an image on the sheet, the image forming apparatus comprising:

a sheet feed tray on which the sheet is placed;

a motor that drivingly rotates a polygon mirror with which a latent image corresponding to the image is formed;

a hardware processor that identifies a type of the sheet based on an output from a sensor provided between the sheet feed tray and a position at which the printing takes place, on a conveyance path for the sheet; and a motor controller that changes a rotation speed of the motor to a first speed, starting from a startup timing synchronized with starting of conveyance of the sheet, wherein the startup timing is set in such a manner that an identification timing at which the type of the sheet is identified arrives while the changing to the first speed is still in progress, and when a second speed corresponding to the type identified is different from the first speed, the motor controller controls the motor to rotate at the second speed.

2. The image forming apparatus according to claim 1, wherein the startup timing is a timing earlier than the identification timing by a set time shorter than a time required for the changing to the first speed.

3. The image forming apparatus according to claim 2, wherein the identification timing is a timing later than a start timing of the conveyance of the sheet by a required identification time including a conveyance time corresponding to a distance between the sheet feed tray and the sensor.

4. The image forming apparatus according to claim 3, wherein the start timing is a timing at which a sheet sensor detects an arrival of the sheet at a detection position closer to the sheet feed tray than to the sensor on the conveyance path.

5. The image forming apparatus according to claim 2, wherein the motor controller adjusts the startup timing by incrementing or decrementing the set time in accordance with a time during which the motor has been in a stopped state before the start of the conveyance of the sheet.

6. The image forming apparatus according to claim 2, wherein the motor controller adjusts the startup timing by incrementing or decrementing the set time based on a total number of sheets that have already been printed.

7. The image forming apparatus according to claim 1, wherein the first speed is slowest one of speeds associated with a plurality of respective anticipated types.

8. The image forming apparatus according to claim 1, further comprising a used type recorder that records a type of the sheet that has been used by a user, wherein the motor controller selects a speed corresponding to a type of the sheet which has been most frequently used, as the first speed.

9. The image forming apparatus according to claim 1, wherein in a case where rotation of the motor is characterized to be stable earlier with deceleration than with acceleration, the first speed is fastest one of speeds associated with a plurality of respective anticipated types.

10. The image forming apparatus according to claim 1, wherein in a case where a time between start of the conveyance of the sheet and identification of the type is shorter than a time required for causing the motor in a stopped state to stably rotate at the first speed, the motor controller starts up the motor before the start of the conveyance of the sheet so that the motor rotates at a preparation rotation speed slower than the first speed at the startup timing.

11. The image forming apparatus according to claim 1, further comprising:

a plurality of the sheet feed trays; and an identified type storage that stores, for each of the plurality of sheet feed trays, a type of the sheet identified while being conveyed from the sheet feed tray, wherein in a case where the sheet is conveyed from one of the sheet feed trays for which the type identified has been stored, the motor controller controls the motor to rotate at a speed associated with the type stored before the start of the conveyance of the sheet without performing control for causing rotation at the first speed.

* * * * *